US007249591B2

(12) United States Patent
Shibata

(10) Patent No.: US 7,249,591 B2
(45) Date of Patent: Jul. 31, 2007

(54) FUEL INJECTION APPARATUS FOR INTERNAL COMBUSTION ENGINE

(75) Inventor: Akira Shibata, Anjo (JP)

(73) Assignee: Denso Corporation, Kariya, Aichi-pref (JP)

( * ) Notice: Subject to any disclaimer, the term of this patent is extended or adjusted under 35 U.S.C. 154(b) by 0 days.

(21) Appl. No.: 11/332,371

(22) Filed: Jan. 17, 2006

(65) Prior Publication Data

US 2006/0162695 A1 Jul. 27, 2006

(30) Foreign Application Priority Data

Jan. 25, 2005 (JP) ..... 2005-016547

(51) Int. Cl.
*F02M 57/00* (2006.01)
*F02M 57/02* (2006.01)

(52) U.S. Cl. ..... 123/446; 123/456

(58) Field of Classification Search ..... 123/446, 123/456, 447, 467, 468, 506, 514; 239/88–92, 239/533.2, 533.5

See application file for complete search history.

(56) References Cited

U.S. PATENT DOCUMENTS 5,682,858 A 11/1997 Chen et al.
6,675,773 B1 * 1/2004 Mahr et al. ..... 123/446
6,752,325 B2 6/2004 Kropp et al.
6,915,785 B2 * 7/2005 Eisenmenger et al. ..... 123/446
6,994,272 B2 * 2/2006 Kurrle et al. ..... 239/96
2003/0019960 A1 * 1/2003 Magel ..... 239/585.5
2004/0050367 A1 * 3/2004 Kurrle et al. ..... 123/472
2005/0035212 A1 * 2/2005 Eisenmenger et al. ..... 239/88
2005/0172935 A1 * 8/2005 Magel et al. ..... 123/446
2005/0224599 A1 * 10/2005 Magel ..... 239/88
2005/0252490 A1 * 11/2005 Magel ..... 123/446
2005/0263133 A1 * 12/2005 Magel ..... 123/446
2005/0274828 A1 * 12/2005 Kurz et al. ..... 239/533.2
2006/0054138 A1 * 3/2006 Geyer ..... 123/446

* cited by examiner

*Primary Examiner*—Mahmoud Gimie
(74) *Attorney, Agent, or Firm*—Nixon & Vanderhye P.C.

(57) ABSTRACT

A first fuel discharge path and a first return pipe that collectively discharge the amount of flow of fuel flowing out of the piston control chamber of a pressure intensifier built in an injector and the amount of flow of fuel flowing out of the nozzle back pressure chamber of a fuel injection nozzle (including the amount of flow of leak fuel) to a fuel tank and a second fuel discharge path and a second return pipe that discharge only the amount of flow of return fuel flowing out of the solenoid valve chamber of a solenoid valve are mounted separately from and independently of each other in terms of pipe line. With this measure, pressure in the solenoid valve chamber can be controlled to a value lower than the limit of resistance to pressure of an O-ring.

10 Claims, 11 Drawing Sheets

FUEL INJECTION APPARATUS FOR INTERNAL COMBUSTION ENGINE

CROSS-REFERENCE TO RELATED APPLICATION

This application is based on Japanese Patent Application No. 2005-16547 filed on Jan. 25, 2005, the disclosure of which is incorporated herein by reference.

FIELD OF THE INVENTION

The present invention relates to a fuel injection apparatus for an internal combustion engine and, in particular, to a pressure intensifying piston type fuel injection apparatus provided with a pressure intensifier capable of intensifying the injection pressure of fuel injected from a fuel injection nozzle to a value more than the discharge pressure of fuel fed from a fuel supply pump.

BACKGROUND OF THE INVENTION

In recent years, for example, regulations on the cleaning of exhaust gas of a diesel engine have become severer and the combustion phenomenon of a diesel engine has been made clearer. With this, to reduce diesel particulates typified by black smoke for the purpose of cleaning exhaust gas exhausted from an engine, it is important to transform fuel injected from the injection portion of a fuel injection nozzle into fine particles of absolute minimum. To further enhance the transforming of fuel into fine particles, it is effective to intensify the injection pressure of fuel.

However, pressure intensified in the fuel injection system for a diesel engine mounted in a vehicle such as an automobile is approaching a limit. For example, also in a common rail type fuel injection system, a request to intensify injection pressure of fuel has become very severe and a request for a value exceeding a limit of resistance to pressure of a supply pump for pressure-supplying fuel to a common rail has been made. U.S. Pat. Nos. 5,682,858 and 6,752,325 show a pressure intensifying piston type fuel injection apparatus for intensifying the injection pressure of fuel to be injected into the cylinder of the engine from an injector to a value larger than the pressure of fuel accumulated in a common rail.

The apparatus, as shown in FIG. 10, is provided with a common rail 101 for accumulating fuel pressure supplied by a fuel injection pump (not shown), a pressure intensifier 102 for intensifying fuel supplied from the common rail 101, a fuel injection nozzle 103 for injecting high-pressure fuel having pressure intensified to a value higher than common rail pressure by the pressure intensifier 102, and a solenoid valve 105 for performing the control of intensifying the pressure of the pressure intensifier 102 and control of opening or closing the fuel injection nozzle 103. Then, the pressure intensifier 102 has a pressure intensifying chamber 111, which is partitioned in a hydraulically hermetic manner by a pressure intensifying piston 110 and a cylinder, a piston back pressure chamber 112, and a piston control chamber 113. Here, the pressure intensifying piston 110 is so constructed as to lift to a side to increase the hydraulic pressure of fuel in the pressure intensifying chamber 111 when the hydraulic pressure of fuel in the piston back pressure chamber 112 becomes higher than the hydraulic pressure of fuel in the piston control chamber 113.

Then, when the hydraulic pressure of fuel introduced from the pressure intensifying chamber 102 into a fuel reservoir exceeds a nozzle opening pressure, the fuel injection nozzle 103 is so constructed as to lift to a side to cause a nozzle needle to open a valve. Here, the nozzle opening pressure is set on the basis of force obtained by adding the biasing force of a spring to the hydraulic pressure of fuel in the nozzle back pressure chamber. Then, the pressure intensifying piston type fuel injection apparatus is integrally provided with the pressure intensifier 102, the fuel injection nozzle 103, and the solenoid valve 105 to construct an injector and a hydraulically operated 2-position 3-way switching valve 104 is built in this injector.

The spool valve 114 of this 2-position 3-way switching valve 104 has a first position capable of introducing fuel discharged from the common rail 101 into the piston control chamber 113 of the pressure intensifier 102 and the nozzle back pressure chamber of the fuel injection nozzle 103, and a second position capable of returning fuel flowing out of the piston control chamber 113 of the pressure intensifier 102 and the nozzle back pressure chamber of the fuel injection nozzle 103 to the low pressure side of a fuel system (fuel tank 107). Then, when the hydraulic pressure of fuel in the pressure control chamber 115 is large, the spool valve 114 of the 2-position 3-way switching valve 104 is set at the first position by the biasing force of a spring 116 and when the hydraulic pressure of fuel in the pressure control chamber 115 is small, the spool valve 114 of the 2-position 3-way switching valve 104 is set at the second position against the biasing force of the spring 116.

The solenoid valve 105 has a solenoid valve chamber 117 built therein and is so constructed to perform the control of increasing or decreasing the hydraulic pressure of fuel in the pressure control chamber 115 to switch the position of the spool valve 114 of the 2-posiiton 3-way switching valve 104. Here, a valve 120 operating integrally with an armature 119 is housed in the solenoid valve chamber 117. Then, the solenoid valve 105 has a solenoid coil 121 for driving the valve 120 in the direction to open the valve and a spring 122 for biasing the valve 120 in the direction to close the valve.

Then, in the injector are formed a first fuel introduction path 131 for introducing fuel from the common rail 101 via the switching valve chamber 123 of the 2-posiiton 3-way switching valve 104 into the piston control chamber 113 of the pressure intensifier 102 and the nozzle back pressure chamber of the fuel injection nozzle 103 and a second fuel introduction path 132 for introducing fuel from the common rail 101 via the piston back pressure chamber 112 of the pressure intensifier 102 and the pressure intensifying chamber 111 of the pressure intensifier 102 into the fuel reserving part of the fuel injection nozzle 103. Then, a first fuel introduction path 133 branched from the first fuel introduction path 131 at a portion closer to the upstream side in the direction of flow of fuel than the switching valve chamber 123 of the 2-posiiton 3-way switching valve 104 introduces fuel from the common rail 101 into the pressure control chamber 115 of the 2-posiiton 3-way switching valve 104.

Then, in the injector are formed a first fuel discharge path 141 for returning fuel from the piston control chamber 113 of the pressure intensifier 102 and the nozzle back pressure chamber of the fuel injection nozzle 103 via the switching valve chamber 123 of the 2-position 3-way switching valve 104 to the fuel tank 107 and a second fuel discharge path 142 for returning fuel from the pressure control chamber 115 of the 2-posiiton 3-way switching valve 104 via the solenoid valve chamber 117 of the solenoid valve 105 to the fuel tank 107. Then, a downstream end in the direction of flow of fuel of the second fuel discharge path 142 is connected to the first fuel discharge path 141 at a portion closer to the downstream side in the direction of flow of fuel than the switching valve chamber 123 of the 2-posiiton 3-way switching valve 104. Then, the first fuel discharge path 141 at a position closer to the downstream side in the direction of flow of fuel than a merging portion 143 where return fuel flowing through the first fuel discharge path 141 merges with return fuel flowing through the second discharge path 142 is connected to a return pipe 106 via the leak port of the injector. The return pipe 106 is a fuel return pipe line for merging the flow of return fuel flowing out of the piston control chamber 113 of the pressure intensifier 102 and the nozzle back pressure chamber of the fuel injection nozzle 103 with the flow of return fuel flowing out of the solenoid valve chamber 117 of the solenoid valve 105 to return the flow of return fuel collectively to the fuel tank 107.

However, in the pressure intensifying piston type fuel injection apparatus, from the operating principle of the pressure intensifier 102, the amount of flow of return fuel more than [(pressure intensifying ratio−1)×the amount of fuel injection (to which the amount of static leak flowing out of the respective sliding portions of the injector and the amount of switching leak caused by the 2-position 3-way switching valve 104 and the solenoid valve 105 (the amount of dynamic leak) are applied] is produced. The return fuel flows out of the leak port of the injector during the period of fuel injection and is returned via the return pipe 106 to the fuel tank 107. For this reason, as shown in FIG. 11, a large positive pressure is developed in the first and second fuel discharge paths 141, 142 and the return pipe 106 (hereinafter referred to as the pressure fluctuation of return fuel).

That is, in the pressure intensifying piston type fuel injection apparatus, there is a possibility that with an increase in the amount of flow of return fuel and an increase in the pressure of return fuel, the pressure fluctuation of return fuel (low-pressure side pressure fluctuation) which does not become a problem in an injector used for a usual common rail type fuel injection system propagates to the solenoid valve chamber 117 of the solenoid valve 105 and exceeds the limit of resistance to pressure of the sealing part such as an O-ring for preventing fuel from leaking from the solenoid valve chamber 117 to the outside. Then, when the apparatus is fastened by screwing to the fuel injection nozzle 103 via the sealing part of the solenoid valve 105, there is a possibility that the sealing part of the solenoid valve 105 is broken (for example, the O-ring is broken) to cause fuel to leak from a portion fastened by screwing. With this, the solenoid valve 105 needs to be further enhanced in resistance to pressure. Hence, there is presented a problem of increasing the cost of the system.

SUMMARY OF THE INVENTION

An object of the present invention is to provide a fuel injection apparatus for an internal combustion engine that has an inexpensive structure but can protect a solenoid valve from the pressure fluctuation of return fuel flowing out of a pressure intensifier or a fuel injection nozzle. Moreover, the object of the present invention is to provide a fuel injection apparatus for an internal combustion engine that can protect a solenoid valve from the pressure fluctuation of return fuel in a return pipe for merging the flow of return fuel flowing out of a pressure intensifier or a fuel injection nozzle with the flow of return fuel flowing out of a solenoid valve to return the flow of return fuel collectively to the low pressure side of a fuel system.

According to the present invention, when a solenoid valve performs the control of intensifying the pressure of a pressure intensifier (specifically, control of the amount of lift of a pressure intensifying piston=control of the degree of intensifying pressure), return fuel flows out of the pressure intensifier. The return fuel flowing out of the pressure intensifier flows through a first fuel discharge path for bypassing the solenoid valve to return fuel to the low-pressure side of the fuel system. Then, when the solenoid valve performs the control of opening or closing a fuel injection nozzle (specifically, control of the fuel injection of an injector=control of the amount of injection and control of injection timing), return fuel flows out of the fuel injection nozzle. The return fuel flowing out of the fuel injection nozzle flows through a second fuel discharge path for bypassing the first fuel discharge path to return fuel to the low-pressure side of the fuel system.

With this, the flow of return fuel flowing out of the pressure intensifier or the fuel injection nozzle is returned directly to the low-pressure side of the fuel system without being merged with return fuel flowing out of the solenoid valve. That is, there is provided a channel structure (pipe line structure) that is not provided with a merging portion where the flow of return fuel flowing out of the pressure intensifier or the fuel injection nozzle merges with the flow of fuel flowing out of the solenoid valve. Hence, this channel structure can prevent the pressure fluctuation of return fuel flowing out of the pressure intensifier or the fuel injection nozzle from propagating to the solenoid valve. Therefore, the fuel injection apparatus according to the present invention has an inexpensive structure but can protect the solenoid valve from the pressure fluctuation of return fuel flowing out of the pressure intensifier or the fuel injection nozzle.

DETAILED DESCRIPTION OF THE PREFERRED EMBODIMENTS

First Embodiment

Construction of First Embodiment

Figure 1:
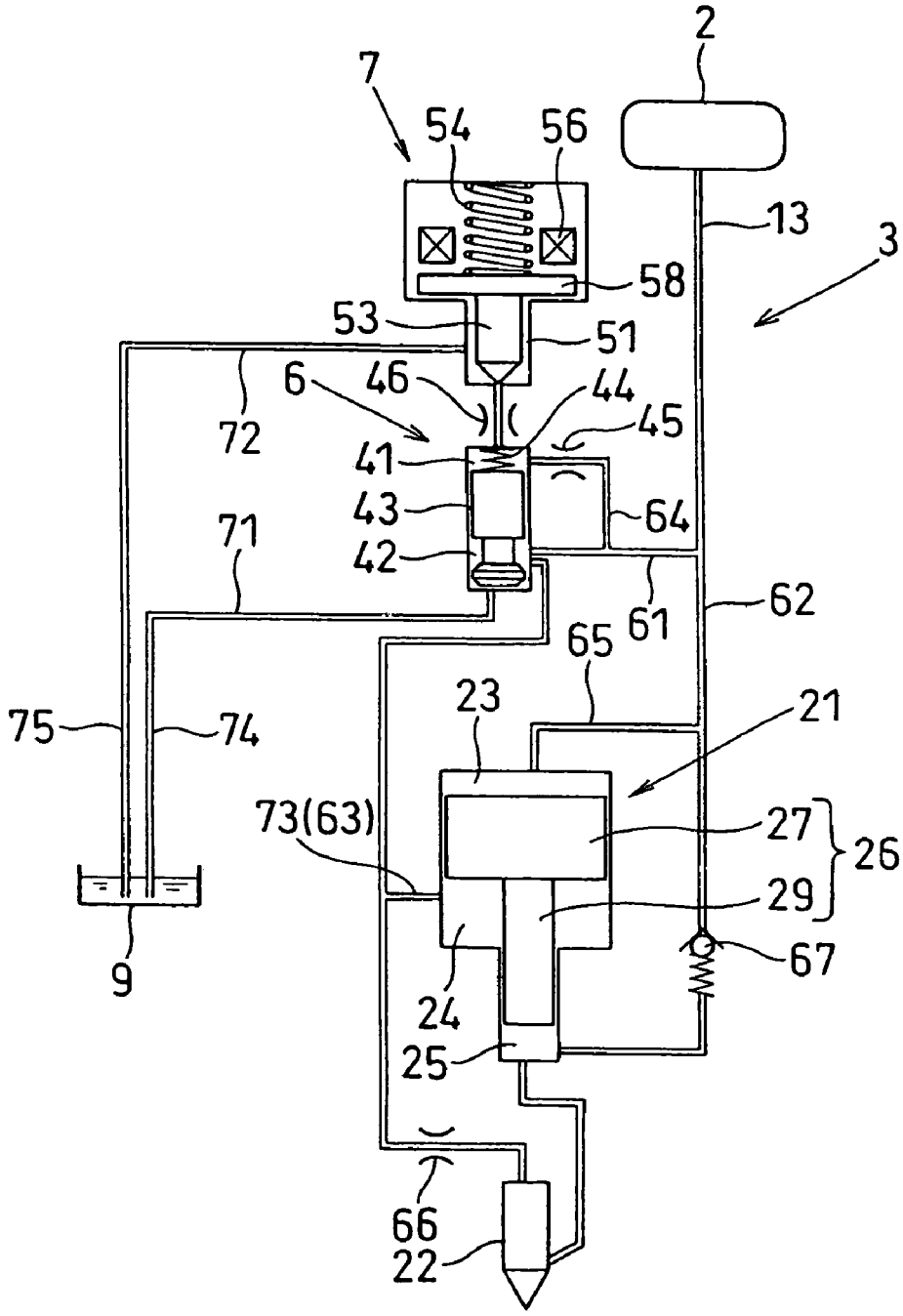
FIG. 1 is a construction diagram showing the fuel piping system of a pressure intensifying piston type fuel injection apparatus (first embodiment).
Figure 2:
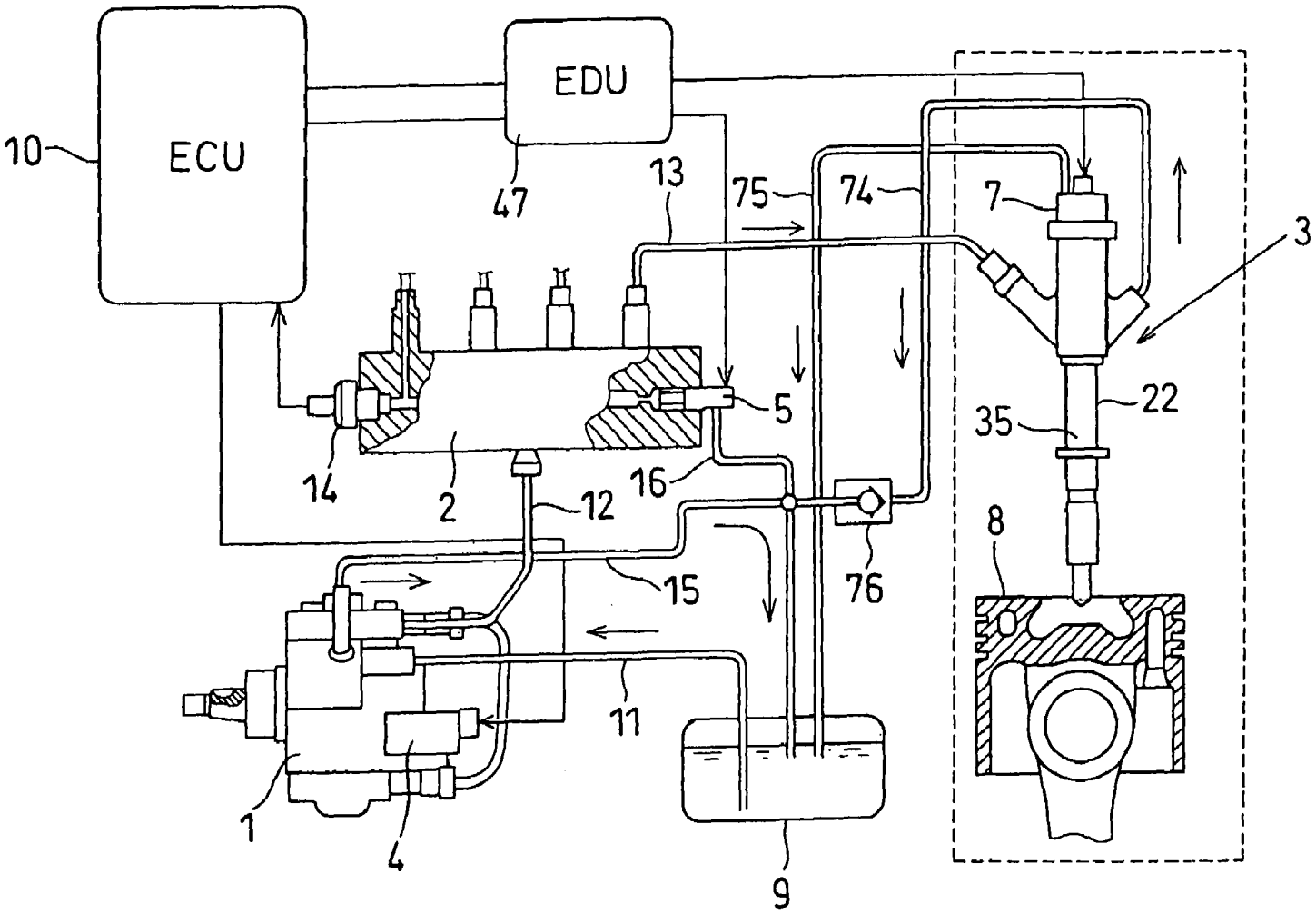
FIG. 2 is a construction diagram showing the general construction of a common rail type fuel injection system (first embodiment).
Figure 3A:
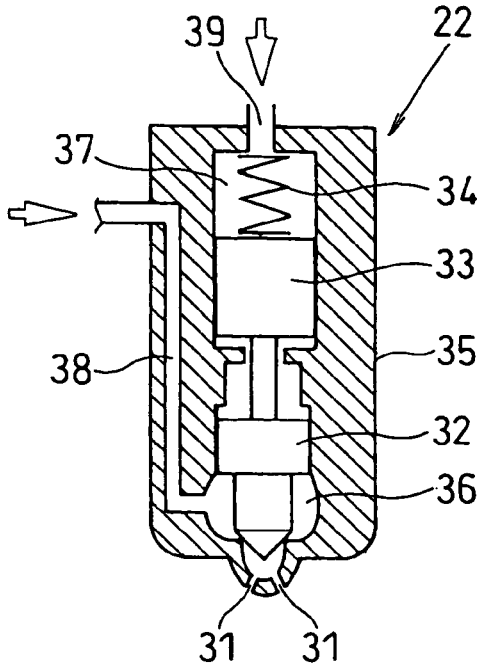
FIGS. 3A and 3B are cross-sectional views showing the schematic construction of a fuel injection nozzle (first embodiment).
Figure 3B:
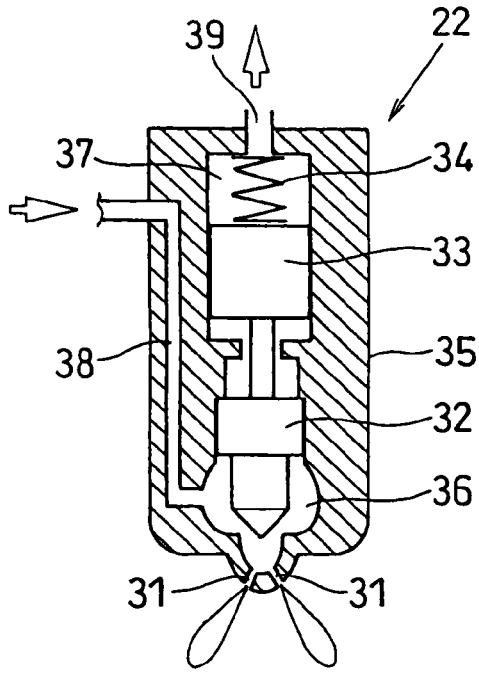

FIG. 1 to FIGS. 3A and 3B show first embodiment of the present invention. FIG. 1 is a diagram showing a fuel piping system of a pressure intensifying piston type fuel injection apparatus and FIG. 2 is a diagram showing the general construction of a common rail type fuel injection system.

A fuel injection apparatus for an internal combustion engine of the present embodiment is mounted on a vehicle such as an automobile and is a common rail type fuel injection system (accumulator type fuel injection system) known as a fuel injection system for an internal combustion engine (multi-cylinder diesel engine: hereinafter referred to as "engine"), for example, diesel engine, and is so constructed as to accumulate fuel discharged from a fuel injection pump (supply pump) 1 in a common rail and to inject the fuel accumulated in the common rail 2 into the combustion chambers of the respective cylinders of the engine via multiple (four in this embodiment) electromagnetic fuel injection valves (injectors) 3 mounted in correspondence with the respective cylinders of the engine.

Moreover, the common rail type fuel injection system, as shown in FIG. 2, is provided with the electromagnetic suction control valve (hereinafter referred to as "solenoid valve") 4 of a supply pump 1, an electromagnetic pressure reducing valve (hereinafter referred to as "pressure reducing valve") 5 arranged in the common rail 2, and an engine control unit (hereinafter referred to as "ECU") 10 for electronically controlling electromagnetic hydraulic pressure control valves (hereinafter referred to as "solenoid valves") 7 of multiple injectors 3. Here, the engine is provided with a crankshaft (output shaft of the engine) for converting the reciprocating motion of a piston 8 to a rotational motion. In this regard, in FIG. 1 and FIG. 2, the injector 3 and its fuel piping system of only one cylinder of the injectors 3 of the respective cylinders of the engine are shown in detail and the injectors 3 of the other three injectors are omitted.

The supply pump 1 of the present embodiment is rotated by the crankshaft of the engine to suck fuel sucked from a fuel tank 9 by a feed pump (not shown) into a pressure chamber to pressurize the fuel. Then, the feed pump is a low-pressure fuel pump that sucks fuel accumulated in the fuel tank 9 and having normal pressure from the suction port of the supply pump 1 via a fuel suction pipe 11 and pressurizes the fuel in it to discharge the fuel into the pressure chamber. Then, the supply pump 1 pressurizes fuel sucked into the pressure chamber by the reciprocating motion of a plunger sliding in the cylinder to increase the pressure of the fuel and discharges the fuel having its pressure increased in the pressure chamber to the common rail through the discharge port of the supply pump 1.

Here, the solenoid valve 4 is mounted in the middle of a fuel suction path from the feed pump to the pressure chamber. This solenoid valve 4 is electronically controlled by a pump driving current applied from the ECU 10 via a pump driving circuit (not shown) to control the amount of suction of fuel sucked into the pressure chamber of the supply pump 1. With this, the amount of fuel discharged from the pressure chamber of the supply pump 1 into the common rail 2 is controlled to an optimum value relating to the operating conditions of the engine (for example, the rotational speed of engine, the amount of operation of accelerator, the instructed amount of injection, and the like), whereby the fuel pressure in the common rail 2, that is, so-called common rail pressure is changed.

The common rail 2 of the present embodiment is connected to the discharge port of the supply pump 1 via a fuel supply pipe 12. This common rail 2 is an accumulator for accumulating fuel discharged from the discharge port of the supply pump 1 and distributing and supplying the fuel of a specified hydraulic pressure to the multiple injectors 3. Then, the common rail 2 is provided with fuel supply pipes 13 in correspondence to the respective injectors 3. Then, the common rail 2 is provided with a fuel pressure sensor (common rail pressure sensor) 14 for detecting a fuel pressure in the common rail 2 (common rail pressure). Surplus fuel flowing out of the supply pump 1 is returned to the lower pressure side (fuel tank 9) of the fuel system via a return pipe 15.

Here, a return pipe 16 from the common rail 2 to the fuel tank 9 is provided with a pressure-reducing valve 5. This pressure reducing valve 5 is a solenoid valve that is electronically controlled by a pressure reducing valve driving current applied by the ECU 10 via a pressure reducing valve driving circuit (EDU) to achieve the excellent pressure reducing performance of reducing a common rail pressure from high pressure to low pressure quickly, for example, at the time of reducing an engine speed or stopping the engine. In this regard, in place of the pressure-reducing valve 5, it is also recommendable to mount a pressure limiter that is opened to render the common rail pressure lower than a limit set pressure when the common rail pressure becomes higher than the limit set pressure.

The injector 3 of the present embodiment is integrally provided with a pressure intensifier 21 capable of intensifying the injection pressure of fuel to pressure higher than the discharge pressure of fuel discharged from the supply pump 1 or the common rail pressure, a fuel injection nozzle 22 for injecting fuel into the combustion chambers of the respective cylinders of the engine, and the solenoid valve 7 for performing the control of intensifying the pressure of the intensifier 21 and the control of opening or closing the fuel injection nozzle 22, thereby constructing a pressure intensifying injector. With this, the common rail type fuel injection system of the present embodiment constructs a pressure intensifying type fuel injection apparatus.

The pressure intensifier 21 of the injector 3 of the present embodiment, as shown in FIG. 1, is mounted in correspondence with each cylinder of the engine, that is, each injector 3. This pressure intensifier 21 is interposed between the common rail 2 and the fuel injection nozzle 22. Then, the pressure intensifier 21 includes a cylinder having a piston backpressure chamber 23, a piston control chamber 24 and a pressure-intensifying chamber (volume varying space) 25, and a pressure-intensifying piston 26 slidably housed in this cylinder.

This pressure-intensifying piston 26 has a large-diameter piston 27 hermetically sliding in a large-diameter bore formed in the cylinder and a small-diameter plunger 29 hermetically sliding in the large-diameter bore formed in the cylinder. The central axes of these large-diameter piston 27 and small-diameter plunger 29 are in close agreement with each other and can be integrally operated. Then, one large-diameter space surrounded by the top end surface in the drawing of the large-diameter piston 27 and the large-diameter bore of the cylinder forms a piston back pressure chamber 23. Then, the other large-diameter space surrounded by the bottom end surface (annular end surface) in the drawing of the large-diameter piston 27 and the large-diameter bore of the cylinder forms a piston control chamber 24.

Moreover, a small-diameter space surrounded by the bottom end surface (annular end surface) in the drawing of the small-diameter plunger 29 and the small-diameter bore of the cylinder forms a pressure-intensifying chamber 25. Then, a return spring (not shown) is housed in the piston control chamber 24. This return spring is interposed between the large-diameter piston 27 of the pressure intensifying piston 26 and the inside wall of the cylinder and functions as piston biasing means for applying a biasing force for returning the lift position of the pressure intensifying piston 26 to an initial position (upward in the drawing) to the pressure intensifying piston 26. Here, the hydraulic force of fuel in the pressure intensifying chamber 25 pressurized by the pressure intensifying piston 26 becomes a value proportional to the ratio (pressure intensifying ratio) of the pressure receiving area of the top end surface in the drawing of the large-diameter piston 27 and the pressure receiving area of the bottom end surface in the drawing of the small-diameter plunger 29. For example, in the case where the ratio of the pressure receiving areas of both end surfaces of the pressure intensifying piston 26 is from 2 to 3, when a hydraulic pressure of 100 MPa is supplied from the common rail 2 to the pressure intensifying chamber 25, fuel having a high pressure of from 200 MPa to 300 MPa is introduced from the pressure intensifying chamber 25 to the fuel injection nozzle 22.

The fuel injection nozzle 22 of the injector 3 of the present embodiment, as shown in FIG. 3, is constructed of a nozzle body having multiple injection ports (nozzle injection ports) 31 formed on its tip side (bottom end side in the drawing), a nozzle needle 32 that is slidably housed in this nozzle body and opens and closes the multiple injection ports 31, a nozzle holder coupled to the nozzle body, and a command piston 33 that is slidably housed in this nozzle holder and moves integrally with the nozzle needle 32 in the axial direction. Then, fuel injection nozzle 22 is mounted with a spring 34 as needle biasing means for biasing the nozzle needle 32 and the command piston 33 in a direction that closes the multiple injection ports 31 (that closes a valve).

A nozzle housing 35 including the nozzle body and nozzle holder is mounted on the cylinder block or the cylinder head of the engine (in correspondence with the respective cylinders). Then, in the nozzle housing 35 are formed a fuel reserving chamber 36 for applying the hydraulic force of fuel to the large-diameter portion of the nozzle needle 32 in a direction that opens the multiple injection ports 31 (that opens the valve), a nozzle back pressure chamber 37 for applying the hydraulic force of fuel to the large-diameter portion of the command piston 33 in a direction that closes the multiple injection ports 31 (that closes the valve), and a fuel introduction passage 38 for introducing high-pressure fuel from the common rail 2 into the fuel reserving chamber 36 via the pressure intensifying chamber 25 of the pressure intensifier 21.

Then, the flow of fuel flowing out of the nozzle back pressure chamber 37, fuel flowing out of the fuel reserving chamber 36 through a sliding gap formed between the large-diameter portion of the nozzle needle 32 and the sliding bore of the nozzle housing 35, and fuel flowing out of the nozzle back pressure chamber 37 through a sliding gap formed between the large-diameter portion of the command piston 33 and the sliding bore of the nozzle housing 35 are returned to the low pressure side (fuel tank 9) through a fuel supply/discharge passage 39. Here, a nozzle opening pressure can be set on the basis of force of the total of the hydraulic force of fuel in the nozzle back pressure chamber 37 and the biasing force of the spring 34. By changing the hydraulic pressure of fuel in the nozzle backpressure chamber 37 or the biasing force of the spring 34, the nozzle opening pressure can be arbitrarily changed.

The solenoid valve 7 of the injector 3 of the present embodiment, as shown in FIG. 1, constructs an electromagnetic hydraulic control valve having a hydraulically operated 2-position 3-way switching valve 6. First, the 2-position 3-way selector valve 6 corresponds to a hydraulically operated 2-positin switching valve of the present invention and is constructed of a housing having a pressure control chamber 41 and a switching valve chamber (oil passage switching chamber) 42, a spool valve (valve body) 43 slidably supported in the sliding bore of this housing, a spring 44 as valve biasing means for biasing this spool valve 43 to an initial position side (lower side in the drawing).

Then, in the wall surface of the housing having a pressure control chamber 41 formed therein are formed an inlet port for introducing fuel from the common rail 2 into the pressure control chamber 41 and an outlet port for returning fuel from the pressure control chamber 41 to the fuel tank 9 via the solenoid valve 7. Then, in the wall surface of the housing having the switching valve chamber 42 formed therein are formed an inlet port for introducing fuel from the common rail 2 into the switching valve chamber 42, an outlet port for returning fuel from the switching valve chamber 42 to the fuel tank 9, and an inlet/outlet port for connecting the piston control chamber 24 of the pressure intensifier 21 and the nozzle back pressure chamber 37 of the fuel injection nozzle 22 to the switching valve chamber 42 of the 2-posiiton 3-way switching valve 6.

The spool valve 43 has a land (large-diameter portion) partitioning the switching valve chamber 42 into a first cylindrical communicating chamber and a second cylindrical communicating chamber. Then, when the hydraulic pressure of fuel in the pressure control chamber 41 is nearly equal to the hydraulic pressure of fuel in the first communicating chamber of the switching valve chamber 42, the spool valve 43 is pressed down in the drawing by the biasing force of the spring 44 and is set at a first position (initial position). With this, the inlet port communicates with the outlet/inlet port via the first communicating chamber of the switching valve chamber 42. Then, when the hydraulic force of fuel in the first communicating chamber of the switching valve chamber 42 is larger than the total of the hydraulic force of fuel in the pressure control chamber 41 and the biasing force of the spring 44, the spool valve 43 is pressed up in the drawing by the hydraulic force of fuel in the first communicating chamber of the switching valve chamber 42 and is set at a second position (full lift position). With this, the outlet/inlet port communicates with the outlet port via a second communicating chamber of the switching valve chamber 42.

Here, the 2-position 3-way switching valve 6 of the present embodiment is constructed in such a way that fuel is introduced from the common rail 2 into the pressure control chamber 41 via a fixed restrictor (inlet side orifice) 45 and that the fuel flows out from the pressure control chamber 41 into the solenoid valve chamber 51 of the solenoid valve 7 via a fixed restrictor (outlet side orifice) 46. Then, in the present embodiment, the diameter of the restrictor (diameter of channel) 46 of the outlet side orifice is made larger than the diameter of the restrictor (diameter of channel) 45 of the inlet side orifice to make the velocity of flow of fuel flowing out of the pressure control chamber 41 larger than the velocity of flow of fuel introduced into the pressure control chamber 41.

The solenoid valve 7 is an electromagnetic actuator that is electronically controlled by an injector driving current applied by the ECU 10 via the injector driving circuit (EDU) 47 to perform the control of intensifying the pressure of the pressure intensifier 21 (control of increasing and decreasing the hydraulic pressure of fuel in the piston control chamber 24, variable control of the amount of lift of the pressure intensifying piston 26) and the control of opening and closing the fuel injection nozzle 22 (control of increasing and decreasing the hydraulic pressure of fuel in the nozzle back pressure chamber 37, variable control of the amount of lift of the nozzle needle 32). The solenoid valve 7 is fastened and fixed to the nozzle housing 35 of the fuel injection nozzle 22 along with the 2-position 3-way switching valve 6 by the use of a retaining nut 48 (refer to FIG. 9).

The solenoid valve 7 is constructed of a housing having a solenoid valve chamber 51, a valve (valve body) 53 slidably supported in the sliding bore of this housing, a spring 54 as valve body biasing means for biasing this valve 53 to the side of the valve 53 being seated on a valve seat (first position side), and an electromagnetic driving part for driving the valve 53 to the side of the valve 53 being separated from the valve seat (second position side). Then, the solenoid valve 7 is provided with a sealing part such as an O-ring 55 (refer to FIG. 9) for preventing fuel from leaking from the solenoid valve chamber 51 to the outside. Then, in the wall surface of the housing having the solenoid valve chamber 51 formed therein are formed an inlet port for connecting the pressure control chamber 41 of the 2-position 3-way switching valve 6 to the solenoid valve chamber 51 and an outlet port for connecting the solenoid valve chamber 51 to the fuel tank 9.

The electromagnetic driving part is valve body driving means for driving the valve 53 to a side opening the inlet port (valve port) (in the direction opening the valve) and includes a solenoid coil 56 that develops a magnetomotive force when energized, a stator core 57 (refer to FIG. 9) magnetized when this solenoid coil 56 is energized, and an armature 58. Here, stator core 57 is provided with an attracting part (not shown) attracting the armature 58 to a side to open the inlet port (valve port). Then, the armature 58 is integral with the valve 53 and moves integrally with the valve 53 in the axial direction.

Here, in the solenoid valve 7 of the present embodiment, when energizing the solenoid coil 56 is stopped (OFF), the valve 53 is seated on the valve seat of the housing by the biasing force of the spring 54, whereby the solenoid valve 7 is controlled to the first position (initial position) closing the inlet port. Then, in the solenoid valve 7, when energizing the solenoid coil 56 is started (ON), the armature 58 is attracted by the attracting part of the stator core 57 and hence the valve 53 is separated from the valve seat of the housing against the biasing force of the spring 54, thereby being controlled to the second position (full lift position) to open the inlet port. At this second position, the solenoid valve chamber 51 communicates with the pressure control chamber 41 via the inlet port the solenoid valve 7 and the solenoid valve chamber 51 communicates with the fuel tank 9 via the outlet port.

Here, fuel accumulated in the common rail 2 is introduced from the common rail 2 into the injectors 3 mounted in correspondence with the respective cylinders of the engine via the respective fuel supply pipes 13. Then, as shown in FIG. 1, in the injector 3 are formed a first fuel introduction path (pipe line, passage, oil passage) 61 for introducing the fuel from the common rail 2 into the nozzle back pressure chamber 37 of fuel injection nozzle 22 via the switching valve chamber 42 of the 2-position 3-way switching valve 6 and a second fuel introduction path (pipe line, passage, oil passage) 62 for introducing high-pressure fuel from the common rail 2 into the fuel reserving chamber 36 of the fuel injection nozzle 22 via the pressure intensifying chamber 25 of the pressure intensifier 21.

Then, the first fuel introduction path 61 has a first fuel introduction path 63 branched from the first fuel introduction path 61 at a position closer to the downstream side (nozzle back pressure chamber 37 side) in the direction of flow of fuel than the switching valve chamber 42 of the 2-position 3-way switching valve 6. This first fuel introduction path 63 is a pipe line (passage, oil passage) for introducing fuel from the common rail 2 into the piston control chamber 24 of the pressure intensifier 21 via the switching valve chamber 42 of the 2-position 3-way switching valve 6. Then, the first fuel introduction path 61 has a first fuel introduction path 64 branched from the first fuel introduction path 61 at a position closer to the upstream side (fuel supply pipe 13 side) in the direction of flow of fuel than the switching valve chamber 42 of the 2-position 3-way switching valve 6. This first fuel introduction path 64 is a pipe line (passage, oil passage) for introducing fuel from the common rail 2 into the pressure control chamber 41 of the 2-position 3-way switching valve 6. Here, a fixed restrictor (orifice) 66 for restricting the cross-sectional area of the passage (the amount of flow of fuel) is interposed in the middle of the first fuel introduction path 61. Then, an inlet side orifice 45 for restricting the cross-sectional area of the passage (the amount of flow of fuel) is interposed in the middle of the first fuel introduction path 64.

Then, the second fuel introduction path 62 has a second fuel introduction path 65 branched from the second fuel introduction path 62 at a position closer to the upstream side (fuel supply pipe 13 side) in the direction of flow of fuel than the pressure intensifying chamber 25 of the pressure intensifier 21. This second fuel introduction path 65 is a pipe line (passage, oil passage) for introducing fuel from the common rail 2 into the piston backpressure chamber 23 of the pressure intensifier 21. Here, a check valve 67 for preventing fuel from flowing out of the pressure-intensifying chamber 25 of the pressure intensifier 21 into the common rail 2 is interposed in the middle of the second fuel introduction path 62. This check valve 67 is constructed of a valve body having a valve port, a valve body for opening and closing the valve port, and valve biasing means such as a spring for biasing the valve body to a side opening and closing the valve port.

Then, as shown in FIG. 1, in the injector 3 are formed a first fuel discharge path (first return passage, pipe line, oil passage) 71 for returning fuel flowing out of the nozzle back pressure chamber 37 of the fuel injection nozzle 22 via the switching valve chamber 42 of the 2-position 3-way switching valve 6 and a second fuel discharge path (second return passage, pipe line, oil passage) 72 for returning fuel flowing out of the pressure control chamber 41 of the 2-position 3-way switching valve 6 via the solenoid valve chamber 51 of the solenoid valve 7. Then, the first fuel discharge path 71 has a first fuel discharge path 73 merging with the first fuel discharge path 71 at a position closer to the upstream side (nozzle back pressure chamber 37 side) in the direction of flow of fuel than the switching chamber 42 of the 2-position 3-way switching valve 6. This first fuel discharge path 73 is a first return passage (pipe line, oil passage) for returning fuel flowing out of the piston control chamber 24 of the pressure intensifier 21 to the fuel tank 9 via the switching valve chamber 42 of the 2-position 3-way switching valve 6.

Then, the first fuel discharge paths 71, 73 bypass the solenoid valve chamber 51 of the solenoid valve 7 and connect the piston control chamber 24 of the pressure intensifier 21 and the nozzle back pressure chamber 37 of the fuel injection nozzle 22 to the fuel tank 9. Then, the second fuel discharge path 72 bypasses the first fuel discharge path 71 and connects the solenoid valve chamber 51 of the solenoid valve 7 to the fuel tank 9. That is, in terms of pipeline, the second discharge path 72 is provided separately from and independently of the first fuel discharge paths 71, 73. Then, an outlet side orifice 46 for restricting the cross-sectional area of the passage (the amount of flow of fuel) is interposed in the middle of the second fuel discharge path 72.

Then, the injector 3 has a first leak port opened at the downstream end in the direction of flow of fuel of the first fuel discharge path 71 and a second leak port opened at the downstream end in the direction of flow of fuel of the second fuel discharge path 72. The second leak port is provided separately from and independently of the first leak port in terms of pipeline. Then, a first return pipe 74 for returning surplus fuel flowing out of the respective injectors 3 (in particular, return fuel flowing out of the piston control chamber 24 of the pressure intensifier 21 and return fuel flowing out of the nozzle back pressure chamber 37 of the fuel injection nozzle 22) to the fuel tank 9 is interposed between the first leak port of the injector 3 and the fuel tank 9.

Then, a second return pipe 75 for returning surplus fuel flowing out of the respective injectors 3 (in particular, return fuel flowing out of the solenoid valve chamber 51 of the solenoid valve 7) to the fuel tank 9 is interposed between the second leak port of the injector 3 and the fuel tank 9. This second return pipe 75 is provided separately from and independently of the first return pipe 74 in terms of pipeline. Here, the first return pipe 74 is a fuel discharge pipe for merging surplus fuel flowing out of the supply pump 1 and passing through the return pipe 15, surplus fuel flowing out of the common rail 2 and passing through the return pipe 16, and surplus fuel flowing out of the respective injectors 3 with each other to return the surplus fuel collectively to the fuel tank 9. A check valve 76 for preventing the pressure fluctuation of the return fuel in the first return pipe 74 is provided at a position closer to the upstream side (injector 3 side) of flow of fuel than the merging portion of this first return pipe 74.

Meanwhile, the ECU 10 is provided with a well-known microcomputer including a CPU for performing control processing and operation processing, and a storage device (memory such as ROM, RAM) for storing various programs and data. Then, a detection signal (voltage signal) from a fuel pressure sensor 14 and sensor signals from other various kinds of sensors are A/D converted by an A/D converter and then are inputted to the microcomputer. Then, the ECU 10 computes the optimum amount of injection of fuel and a fuel injection timing according to the operating state or the operating condition of the engine. Specifically, the ECU 10 computes the basic amount of injection of fuel by the engine rotational speed detected by rotational speed detecting means (not shown) such as a crank angle sensor and an accelerator position detected by engine load detecting means (not shown) such as an accelerator position sensor.

Next, the amount of injection to be instructed is computed by adding the corrected amount of injection in consideration of the temperature of engine cooling water and the temperature of fuel to the basic amount of injection of fuel. Next, instructed injection timing is computed by the rotational speed of the engine and an accelerator position. Alternatively, instructed injection timing is computed by the rotational speed of the engine and the instructed amount of injection. Next, a period of time during which the solenoid coil 56 of the solenoid valve 7 of the injector 3 is energized (instructed period of time of injection) is computed by the instructed amount of injection and the common rail pressure. In this regard, it is also recommendable to measure the hydraulic pressure of fuel in the pressure intensifying chamber 25 (hydraulic pressure corresponding to the injection pressure of fuel) in place of the common rail pressure and to compute a period of time during which the solenoid coil 56 of the solenoid valve 7 is energized (instructed period of time of injection).

Operation of First Embodiment

Next, the operation of a common rail type fuel injection system of the present embodiment will be described in brief on the basis of FIG. 1 to FIGS. 3A and 3B.

When energizing the solenoid coil 56 of the solenoid valve 7 of the injector 3 is stopped (OFF), the valve 53 of the solenoid 7 is seated on the valve seat of the housing by the biasing force of the spring 54, thereby being pressed onto the first position to close the inlet port. For this reason, fuel accumulated in the common rail 2 is introduced from the fuel supply pipe 13 into the pressure control chamber 41 of the 2-position 3-way switching valve 6 via the fuel introduction paths 61, 64.

Meanwhile, fuel is introduced from the fuel supply pipe 13 of the common rail 2 into the first communication chamber of the switching chamber 42 of the 2-position 3-way switching valve 6 via the first fuel introduction path 61. Then, as described above, fuel is introduced from the fuel supply pipe 13 of the common rail 2 also into the pressure control chamber 41 of the 2-position 3-way switching valve 6 via the first fuel introduction path 64. For this reason, the hydraulic pressures of fuel (corresponding to the common rail pressure) applied to both end surfaces of the spool valve 43 of the 2-position 3-way switching valve 6 are nearly equal to each other. In this manner, the spool valve 43 of the 2-position 3-way switching valve 6 is controlled to the first position (initial position) where it is seated on the valve seat of the housing by the biasing force of the spring 44 mounted in the pressure control chamber 41.

For this reason, the inlet port of the 2-position 3-way switching valve 6 communicates with the outlet/inlet port via the first communication chamber of the switching valve chamber 42. With this, fuel accumulated in the common rail 2 is introduced from the fuel supply pipe 13 into the nozzle back pressure chamber 37 of the fuel injection nozzle 22 via the first fuel introduction path 61, the first communication chamber of the switching valve chamber 42, and the first fuel introduction path 61. Furthermore, fuel accumulated in the common rail 2 is introduced into the piston control chamber of the pressure intensifier 21 via the first fuel introduction path 63.

Meanwhile, fuel is introduced from the fuel supply pipe 13 of the common rail 2 into the piston back pressure chamber 23 of the pressure intensifier 21 via the second fuel introduction path 62 and, as described above, fuel is introduced from the fuel supply pipe 13 of the common rail 2 into the piston control chamber 24 of the pressure intensifier 21 via the first fuel introduction path 61. For this reason, the hydraulic pressures of fuel (corresponding to the common rail pressure) applied to both end surfaces of the large-diameter piston 27 of the pressure intensifying piston 26 are nearly equal to each other and hence the pressure intensifying piston 26 is positioned on the upper side in the drawing in the large-diameter bore of the cylinder by the biasing force of the return spring mounted in the piston control chamber 24.

With this, the amount of lift of the pressure-intensifying piston 26 becomes 0 (initial position). Therefore, the internal volume of a pressure intensifying chamber surrounded by the bottom end surface in the drawing of the small-diameter plunger 29 of the pressure intensifying piston 26 and the small-diameter bore of the cylinder is brought to the largest state and hence the fuel pressure in the pressure intensifying chamber 25 of the pressure intensifier 21 cannot be intensified to pressure higher than the common rail pressure. With this, the hydraulic pressure of fuel introduced from the fuel supply pipe 13 of the common rail 2 into the fuel reserving chamber 36 of the fuel injection nozzle 22 via the second fuel introduction path 62, the pressure intensifying chamber 25, and the second fuel introduction path 62 is kept at the common rail pressure.

Meanwhile, as described above, fuel is introduced from the fuel supply pipe 13 of the common rail 2 into the nozzle backpressure chamber 37 of the fuel injection nozzle 22 via the first fuel introduction path 61. For this reason, the hydraulic pressure of fuel in the nozzle back pressure chamber 37 of the fuel injection nozzle 22 is also brought to the same common rail pressure as the hydraulic pressure of fuel in the fuel reserving chamber 36 and the command piston 33 and the nozzle needle 32 of the fuel injection nozzle 22 are pressed onto the valve seats of the nozzle housing 35 by the biasing force of the spring 34. For this reason, the multiple injection ports 31 cannot be opened and hence fuel is not injected into the combustion chamber of the cylinder of the engine.

Then, when the piston position of the cylinder of the engine is brought near to a top dead center and the instructed injection timing of the cylinder of the engine comes, energizing the solenoid coil 56 of the solenoid valve 7 of the injector 3 is started (ON). Then, the stator core 57 and the armature 58 are magnetized and hence the armature 58 is attracted by the attracting part of the stator core 57 against the biasing force of the spring 54. With this, the valve 53 of the solenoid valve 7 is separated from the valve seat of the housing against the biasing force of the spring 54, thereby being controlled to the second position (full lift position) to open the inlet port. For this reason, the inlet port and the outlet port of the solenoid valve 7 communicate with each other via the solenoid valve chamber 51.

With this, fuel in the pressure control chamber 41 of the 2-position 3-way switching valve 6 flows out of the outlet port of the 2-position 3-way switching valve 6 and flows into the solenoid valve chamber 51 of the solenoid valve 7 through the inlet port of the solenoid valve 7. Then, fuel flowing into the solenoid valve chamber 51 of the solenoid valve 7 flows out of the outlet port of the solenoid valve 7 and flows out through the second leak port via the second fuel discharge path 72 to the outside of the injector 3. Then, fuel flowing out of the second leak port of the injector 3 flows through the second return pipe 75 and returns to the fuel tank 9 without merging with return fuel flowing through the first fuel discharge path 71 and the first return pipe 74.

Here, the 2-position 3-way switching valve 6 of the present embodiment is constructed in such a way as to introduce fuel from the common rail 2 into the pressure control chamber 41 via the inlet side orifice 45 and to allow fuel to flow out of the pressure control chamber 41 into the solenoid valve chamber 51 of the solenoid valve 7 via the outlet side orifice 46. Then, by making the diameter of a restrictor (diameter of channel) of the outlet side orifice 46 larger than the diameter of a restrictor (diameter of channel) of the inlet side orifice 45, the velocity of flow of fuel flowing out of the pressure control chamber 41 is made larger than the velocity of flow of fuel introduced into the pressure control chamber 41 to improve the control responsivity of the 2-position 3-way switching valve 6 to the valve opening operation of the solenoid valve 7. With this, as described above, fuel in the pressure control chamber 41 of the 2-position 3-way switching valve 6 flows out speedily and hence the hydraulic pressure of fuel in the pressure control chamber 41 of the 2-position 3-way switching valve 6 starts to decrease quickly.

Then, when the hydraulic force of fuel in the first communication chamber of the switching valve chamber 42 becomes higher than the total of the hydraulic force of fuel in the pressure control chamber 41 and the biasing force of the spring 44, the spool valve 43 of the 2-position 3-way switching valve 6 starts to lift by the hydraulic force of fuel in the first communication chamber of the switching valve chamber 42. With this, the spool valve 43 of the 2-position 3-way switching valve 6 is controlled to the second position (full lift position) where the spool valve 43 is separated from the valve seat of the housing. For this reason, the outlet/inlet port and outlet port of the 2-position 3-way switching valve 6 communicates with each other via the second communication chamber of the switching valve chamber 42. With this, fuel introduced into the nozzle back pressure chamber 37 of the fuel injection nozzle 22 flows out of the nozzle back pressure chamber 37 and flows through the first fuel discharge path 71 and the outlet/inlet port of the 2-position 3-way switching valve 6 into the second communication chamber of the switching valve chamber 42 of the 2-position 3-way switching valve 6.

Furthermore, fuel introduced into the piston control chamber 24 of the pressure intensifier 21 flows out of the piston control chamber 24 and flows through the first fuel discharge path 73 and then merges with fuel flowing out of the nozzle back pressure chamber 37 and then flows through the outlet/inlet port of the 2-position 3-way switching valve 6 into the second communication chamber of the switching valve chamber 42 of the 2-position 3-way switching valve 6. Then, fuel flowing into the second communication chamber of the switching valve chamber 42 of the 2-position 3-way switching valve 6 flows out of the outlet port of the 2-position 3-way switching valve 6 and flows through the first fuel discharge path 71 and flows out of the first leak port to the outside of the injector 3. Then, fuel flowing out of the first leak port of the injector 3 flows through the first return pipe 74 and returns to the fuel tank 9 without merging with return fuel flowing through the second fuel discharge path 72 and the second return pipe 75.

Meanwhile, fuel is introduced from the fuel supply pipe 13 of the common rail 2 into the piston backpressure chamber 23 of the pressure intensifier 21 via the second fuel introduction path 62. Hence, when fuel flows out of the piston control chamber 24 of the pressure intensifier 21, a pressure difference is produced between the hydraulic pressures applied to both end surfaces of the large-diameter piston 27 of the pressure-intensifying piston 26. Then, when force of the total of the hydraulic force of fuel in the piston control chamber 24 and the biasing force of the return spring becomes smaller than the hydraulic force of fuel in the piston back pressure chamber 23, the pressure intensifying piston 26 starts to lift downward in the drawing. With this, after a specified standby time passes from starting energizing the solenoid coil 56 of the solenoid valve 7 (ON), the internal volume of the pressure-intensifying chamber 25 starts to become smaller and starts to intensify the pressure of fuel in the pressure-intensifying chamber 25. For this reason, the hydraulic pressure of fuel in the fuel-reserving chamber 36 of the fuel injection nozzle 22 starts to increase.

Thereafter, when the hydraulic force of fuel in the fuel reserving chamber 36 becomes larger than the total of the hydraulic force of fuel in the nozzle back pressure chamber 37 and the biasing force of the spring 34, the command piston 33 and the nozzle needle 32 of the fuel injection nozzle 22 starts to lift by the hydraulic force of fuel in the fuel reserving chamber 36 and the nozzle needle 32 is separated from the valve seat. Therefore, the fuel injection nozzle 22 is opened and hence the multiple injection ports 31 are opened to start injecting fuel into the combustion chamber of the cylinder of the engine. At this time, high-pressure fuel intensified in response to the lift position of the pressure-intensifying piston 26 is injected into the combustion chamber of the cylinder of the engine.

Thereafter, when the instructed period of time of injection corresponding to the instructed amount of injection of fuel (period of time during which the solenoid coil 56 of the solenoid valve 7 is energized) passes from the instructed injection timing, energizing the solenoid coil 56 of the solenoid valve 7 is stopped (OFF). Then, the stator core 57 and the armature 58 are demagnetized and hence the valve 53 of the solenoid valve 7 is controlled by the biasing force of the spring 54 to the first position (initial position) where the valve 53 is seated on the valve seat of the housing. For this reason, the spool valve 43 of the 2-posiiton 3-way switching valve 6 is controlled by the biasing force of the spring 44 to the first position (initial position) where the spool valve 43 is seated on the valve seat of the housing.

With this, fuel accumulated in the common rail 2 is introduced from the fuel supply pipe 13 through the first fuel introduction path 61, the first communication chamber of the switching chamber 42, and the first fuel introduction paths 61, 63 into the piston control chamber 24 of the pressure intensifier 21 and the nozzle back pressure chamber 37 of the fuel injection nozzle 22. Then, the common rail pressure is introduced into the piston control chamber 24 and the hydraulic force of fuel in the piston control chamber 24 starts to increase. Then, force of the total of the hydraulic force of fuel in the piston control chamber 24 and the biasing force of the return spring becomes larger than the hydraulic force of fuel in the piston back pressure chamber 23, the pressure intensifying piston receives the assistance of the biasing force of the return spring and hence the amount of lift of the pressure intensifying piston 26 becomes smaller.

With this, the internal volume of the pressure-intensifying chamber 25 is increased and hence the hydraulic force of fuel in the pressure-intensifying chamber 25 starts decreasing. Thereafter, when the hydraulic force of fuel in the fuel reserving chamber 36 becomes lower than the total of the hydraulic force of fuel in the nozzle back pressure chamber 37 and the biasing force of the spring 34, the nozzle needle 32 starts to move in such a direction as to close the valve and is seated on the valve seat. Therefore, the fuel injection nozzle 22 is closed and hence the multiple injection ports 31 formed in the tip of the nozzle housing 35 are closed to finish fuel injection into the combustion chamber of the cylinder of the engine.

Feature of First Embodiment

Here, when the solenoid valve 7 of the injector 3 is opened, fuel flows out of the nozzle backpressure chamber 37 of the fuel injection nozzle 22 into the fuel tank 9. At this time, when the pulsation of pressure of leak fuel overflowing out of the respective sliding portions of the fuel injection nozzle 22 and return fuel discharged from the nozzle back pressure chamber 37 becomes larger than 10 MPa and the pulsation of pressure of leak fuel and return fuel has an effect on the solenoid valve chamber 51 of the solenoid valve 7, the pulsation of pressure exceeds the limit of resistance to pressure of the O ring 55 (for example, the order of 3 MPa). For this reason, in the injector commonly used for the common rail type fuel injection system, the pulsation of pressure of return fuel has been conventionally set at a value lower than the order of 3 MPa. This value has been achieved by the amount of flow of return fuel into which the amount of flow of leak fuel overflowing out of the respective sliding portions of the fuel injection nozzle and the amount of flow of return fuel flowing out of the nozzle back pressure chamber of the fuel injection nozzle are merged with each other in the solenoid valve chamber of the solenoid valve.

In this regard, the above-mentioned amount of flow of leak fuel means the amount of flow of fuel (the amount of static leak of injector) of the total of the amount of flow of leak fuel, which overflows out of the respective sliding portions of the fuel injection nozzle, for example, in the fuel injection nozzle 22 in FIG. 3, out of the fuel reserving portion 36 through the sliding gap between the large-diameter portion of the nozzle needle 32 and the sliding bore of the nozzle housing 35 into a leak passage (not shown), and the amount of flow of leak fuel, which overflows out of the nozzle back pressure chamber 37 through the sliding gap between the large-diameter portion of the command piston 33 and the sliding bore of the nozzle housing 35 into a leak passage (not shown). Then, the above-mentioned amount of flow of return fuel means the amount of leak of fuel (the amount of dynamic leak of the injector) flowing out of the nozzle back pressure chamber of the fuel injection nozzle and discharged into the fuel tank of the lower side of the fuel system when the solenoid valve is opened to cause the injector to inject fuel.

However, in the pressure intensifying piston type fuel injection apparatus like the present embodiment, fuel is discharged from both of the piston control chamber 24 of the pressure intensifier 21 and the nozzle back pressure chamber 37 of the fuel injection nozzle 22 to control the amount of lift of the pressure intensifying piston 26 of the pressure intensifier 21 and the timing when the valve is opened by the nozzle needle 32 of the fuel injection nozzle 22 or the period of time during which the valve is opened. Therefore, the amount of flow of return fuel is remarkably increased as compared with an injector used for the typical common rail type fuel injection system. That is, the amount of flow of return fuel flowing out of the piston control chamber 24 of the pressure intensifier 21 is added to the above-mentioned amount of flow of fuel and the above-mentioned amount of flow of return fuel.

Figure 10:
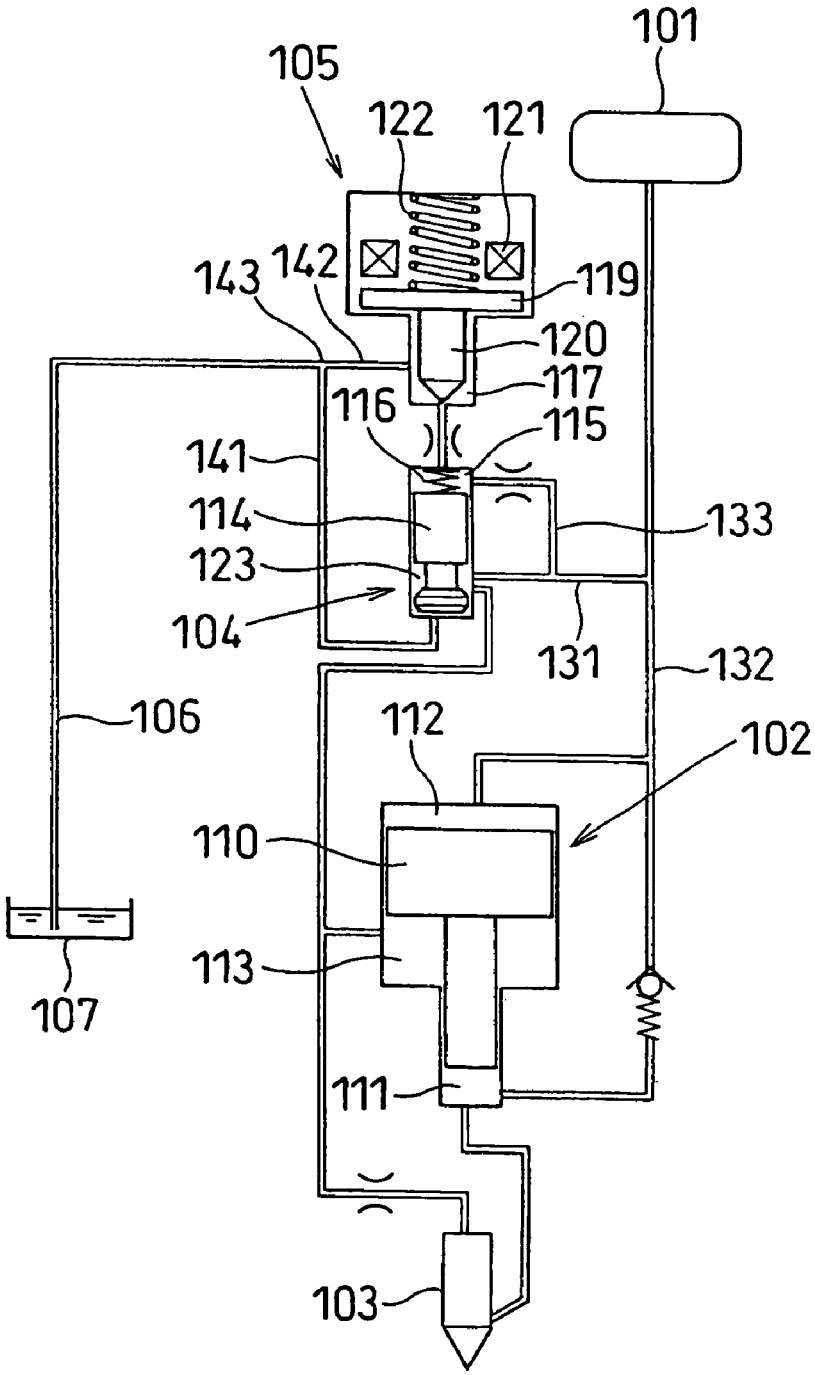
FIG. 10 RELATED ART
FIG. 10 is a construction diagram showing the fuel introduction path and fuel discharge path of an injector (related art).
Figure 11:
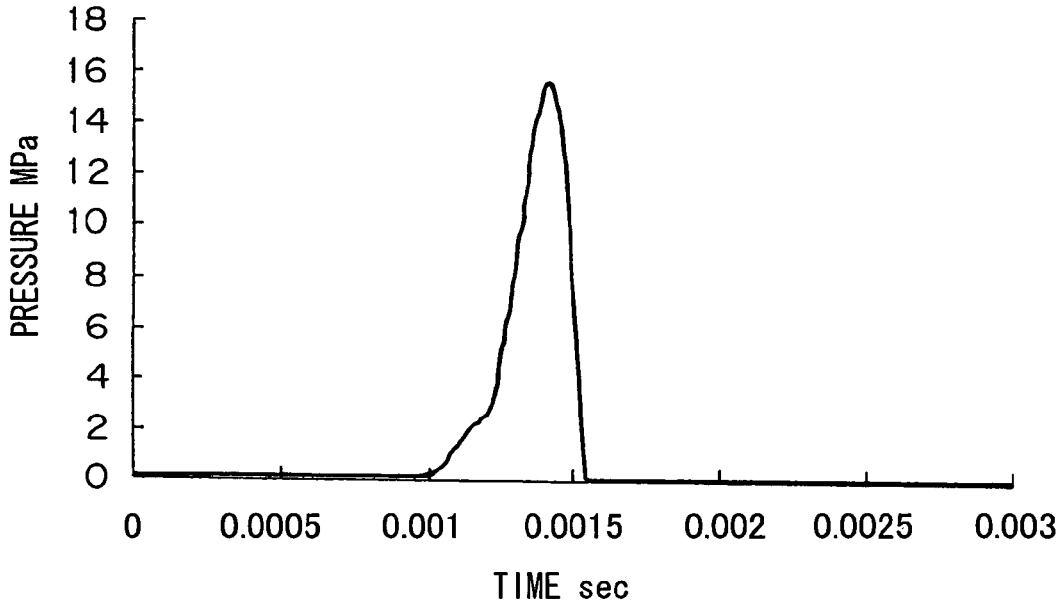
FIG. 11 RELATED ART
FIG. 11 is a graph showing a pressure fluctuation waveform in a return pipe in FIG. 10 (related art).

For this reason, as is the case with the injector used for the typical common rail type fuel injection system, as shown in FIG. 10, when the amount of flow of return fuel flowing out of the piston control chamber 113 of a pressure intensifier 102, the amount of flow of return fuel flowing out of the nozzle back pressure chamber of a fuel injection nozzle 103 (including the amount of flow of leak fuel flowing out of the respective sliding portions), and the amount of flow of return fuel flowing out of the solenoid valve chamber 117 of a solenoid valve 105 are merged with each other at a merging portion 143 and are discharged collectively through one return pipe 106 into a fuel tank 107, as shown in FIG. 11, there is caused a malfunction that a large pulsation of return fuel develops and exceeds the limit of resistance to pressure (for example, the order of 3 MPa) of a sealing part such as the O ring of the solenoid valve 105.

Then, in the common rail type fuel injection system of the present embodiment (in particular, the injector 3 having the pressure intensifying piston 26 built therein), the first fuel discharge path 71 and the first return pipe 74, which collectively discharge the amount of flow of return fuel flowing out of the piston control chamber 24 of the pressure intensifier 21 and the amount of flow of return fuel flowing out of the nozzle back pressure chamber 37 of the fuel injection nozzle 22 (including the amount of flow of leak fuel from the respective sliding portions) into the fuel tank 9, and the second fuel discharge path 72 and the second return pipe 75, which discharge only the amount of flow of return fuel flowing out of the solenoid valve chamber 51 of the solenoid valve 7 into the fuel tank 9, are provided (or formed) separately from and independently of each other in terms of pipe line.

With this, the flow of return fuel flowing out of the piston control chamber 24 of the pressure intensifier 21 and the flow of return fuel flowing out of the nozzle back pressure chamber 37 of the fuel injection nozzle 22 are returned directly into the fuel tank 9 through the first return pipe 74 without merging with the flow of return fuel flowing out of the solenoid chamber 51 of the solenoid valve 7. That is, there is provided a channel construction (pipe line construction) that does not include a merging portion where the flow of return fuel flowing out of the piston control chamber 24 of the pressure intensifier 21 and the flow of return fuel flowing out of the nozzle back pressure chamber 37 of the fuel injection nozzle 22 and the flow of return fuel flowing out of the solenoid valve chamber 51 of the solenoid valve 7 merge with each other. With this, it is possible to reliably prevent the pressure fluctuation of return fuel flowing out of the piston control chamber 24 of the pressure intensifier 21 and the nozzle back pressure chamber 37 of the fuel injection nozzle 22, that is, the pressure fluctuation of return fuel developing in the first fuel discharge path 71 and the first return pipe 74 from propagating through the second fuel discharge path 72 and the second return pipe 75 and further the solenoid valve chamber 51 of the solenoid valve 7 when the fuel injection control of the injector 3 (control of the amount of injection of fuel, control of injection timing, and control of the amount of lift of the pressure intensifying piston 26) is performed. Therefore, such a large pressure fluctuation of return fuel that exceeds the limit of resistance to pressure (for example, the order of 3 MPa) of the sealing part such as an O-ring of the solenoid valve 7 does not propagate through the solenoid valve chamber 51 of the solenoid valve 7. Therefore, although the common rail type fuel injection system of the present embodiment has an inexpensive structure, the fuel injection system can protect the sealing part (and portions fastened by screwing) such as the O ring 55 of the solenoid valve 7 from the pressure fluctuation of return fuel flowing out of the piston control chamber 24 of the pressure intensifier 21 and the nozzle back pressure chamber 37 of the fuel injection nozzle 22. This can eliminate the need for further improving the resistance to pressure of the solenoid valve 7 and hence can reduce the cost of the whole of the system.

Here, the present embodiment is constructed in such a way that return fuel returned from the piston control chamber 24 of the pressure intensifier 21 into the fuel tank 9 and return fuel (including leak fuel) returned from the nozzle back pressure chamber 37 of the fuel injection nozzle 22 into the fuel tank 9 and return fuel returned from the solenoid valve chamber 51 of the solenoid valve 7 into the fuel tank 9 are returned separately from each other in terms of pipe line through the first return pipe 74 and the second return pipe 75, which are separated from each other, into the fuel tank 9. However, while the check valve 76 is provided in the first return pipe 74 in the system shown in FIG. 7, it is also recommendable to connect the outlet portion of the second return pipe 75 to the first return pipe 74 between the check valve 76 and the fuel tank 9. In this case, return fuel flowing out of the solenoid valve chamber 51 of the solenoid valve 7 merges with the first return pipe (for example, rubber pipe portion) 74 closer to the downstream side in the direction of the flow of fuel than the check valve 76 and hence the pressure fluctuation of return fuel in the first return pipe 74 significantly attenuates and hence the large pressure fluctuation of return fuel does not propagate through the solenoid valve chamber 51 of the solenoid valve 7.

Here, the object of providing the first return pipe 74 with the check valve 76 is to stabilize fuel pressure in the first return pipe 74 at pressure lower than a set pressure except for several msec after return fuel flowing into the first return pipe 74 to exclude the effect caused by the low-pressure side fluctuation in the amount of injection of fuel injected into the combustion chamber of each cylinder of the engine. Then, in the first return pipe 74 provided with the check valve 76, fuel of the amount large than the amount of inflow of fuel flows out of the check valve 76 due to the pressure increased by the inflow of return fuel and hence fuel pressure in the first return pipe 74 closer to the upstream side in the direction of flow of fuel than the check valve 76 once becomes negative pressure of the vapor pressure of fuel. This negative pressure is recovered to pressure to open the check valve 76 in a short time by fuel always leaking in the injector 3. Thereafter, the fuel pressure in the first return pipe 74 is kept at pressure to open the check valve 76 until return fuel of the injector 3 of the next cylinder flows in (refer to FIG. 8). In this regard, in the first return pipe 74 having the check valve 76 not provided, fuel pressure increased by the inflow of return fuel reciprocates in the first return pipe 74 and the fuel pressure in the first return pipe 74 repeatedly decreases to negative pressure of the vapor pressure of fuel and increases to positive pressure higher than 10 MPa (refer to FIG. 6).

Second Embodiment

Construction of Second Embodiment

Figure 4:
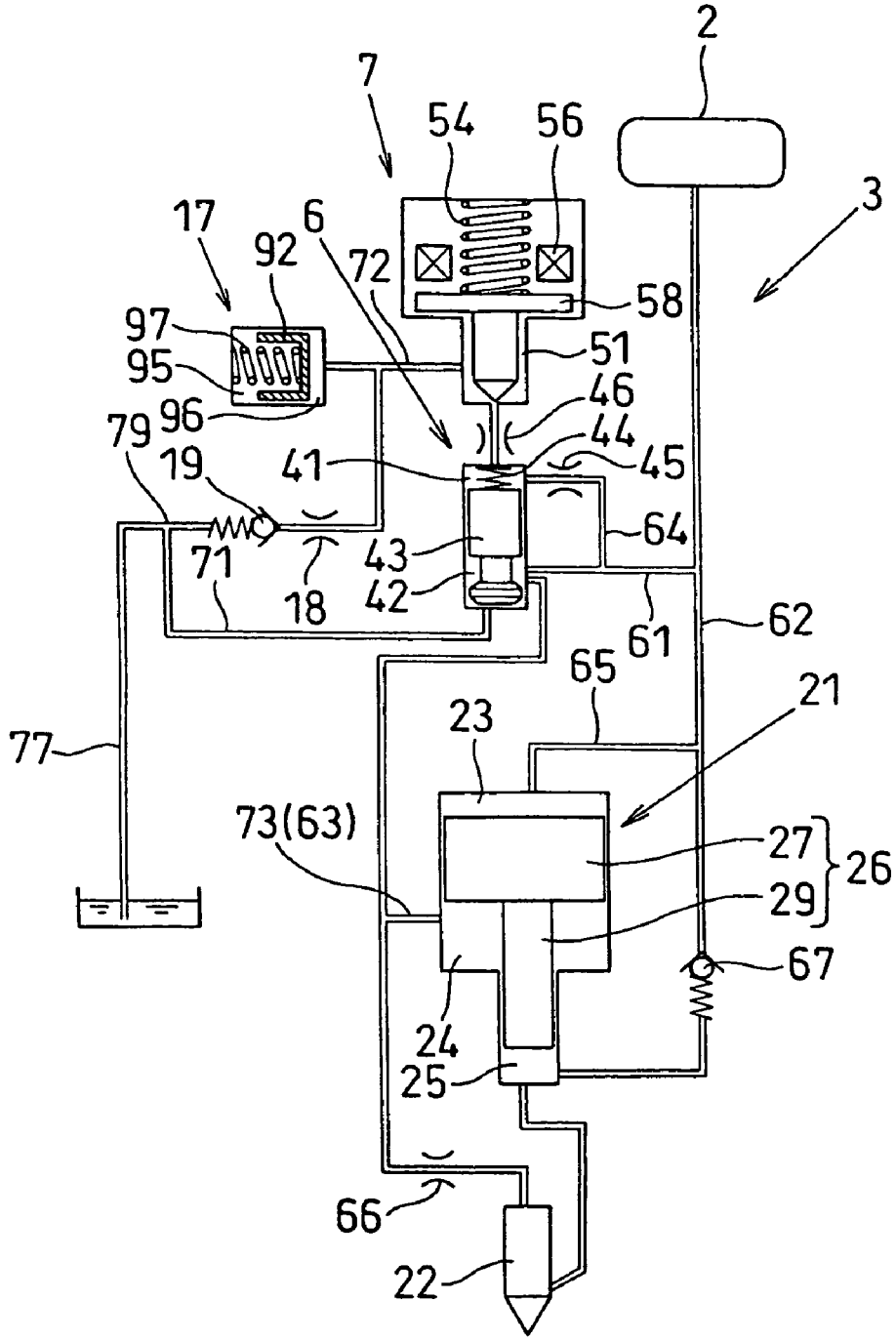
FIG. 4 is a construction diagram showing the fuel piping system of a pressure intensifying piston type fuel injection apparatus (second embodiment).
Figure 5:
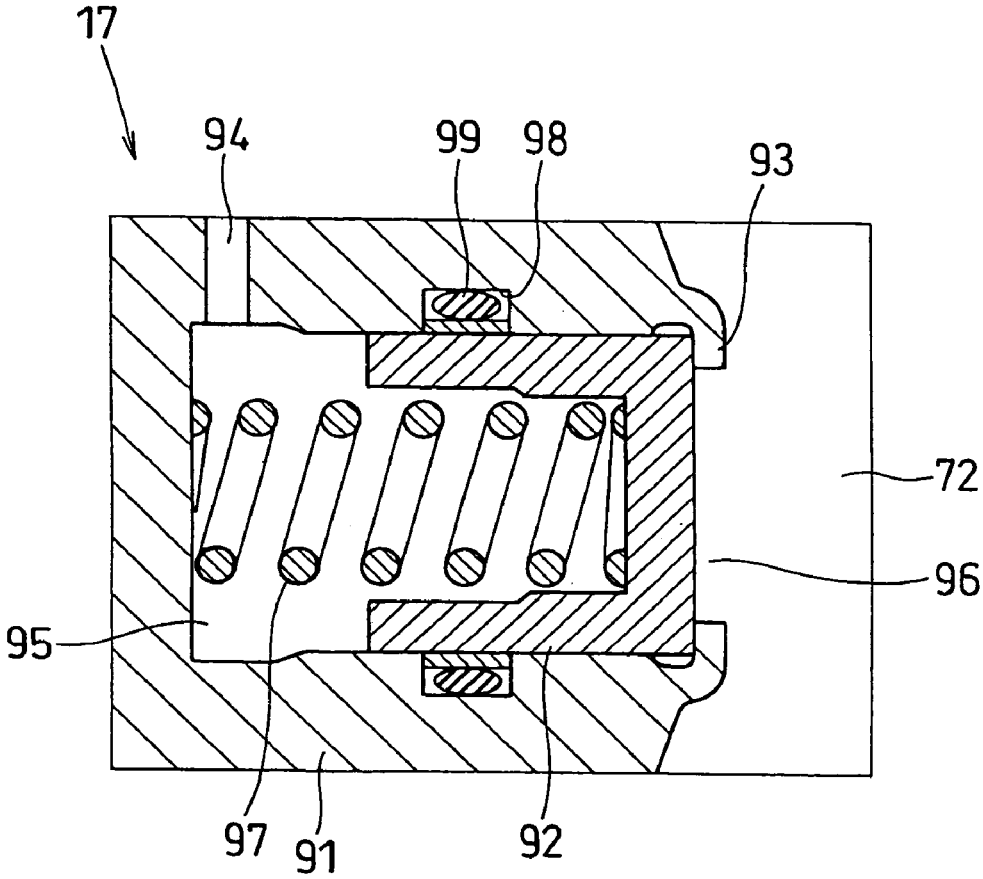
FIG. 5 is a cross-sectional view showing a pressure fluctuation preventing unit (second embodiment).
Figure 6:
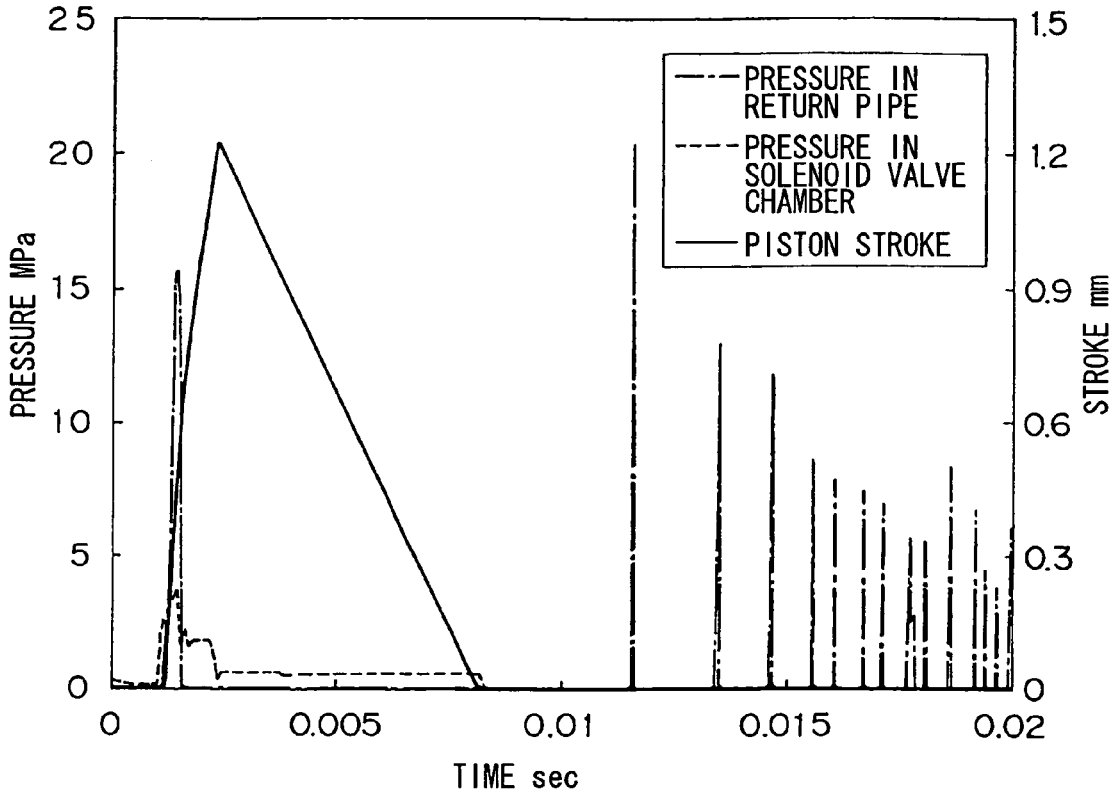
FIG. 6 is a timing chart showing the simulation result of the fuel piping system in FIG. 4 (second embodiment).

FIG. 4 to FIG. 6 show the second embodiment of the present invention. FIG. 4 is a diagram showing the fuel piping system of a pressure intensifying piston type fuel injection apparatus and FIG. 5 is a diagram showing a pressure fluctuation preventing device.

The injector 3 of the present embodiment is integrally provided with the pressure intensifier 21, the fuel injection nozzle 22, the 2-position 3-way switching valve 6, the solenoid valve 7, and the like to construct a pressure intensifying type injector. With this, the common rail type fuel injection system of the present embodiment constructs a pressure intensifying piston type fuel injection apparatus. This system is provided with a return pipe 77 for returning return fuel flowing out of the inside of the injector 3 to the low pressure side (fuel tank 9) of the fuel system and pressure fluctuation propagation preventing means for preventing the pressure fluctuation of return fuel in this return pipe 77 from propagating to the solenoid valve chamber 51 of the solenoid valve 7, which is different in construction from first embodiment.

Here, as shown in FIG. 4, in the injector 3 are formed a first fuel discharge path 71 for returning fuel flowing out of the nozzle back pressure chamber 37 of the fuel injection nozzle 22 through the switching valve chamber 42 of the 2-posiiton 3-way switching valve 6 into the fuel tank 9 and a second fuel discharge path 72 for returning fuel flowing out of the pressure control chamber 41 of the 2-posiiton 3-way switching valve 6 through the solenoid valve chamber 51 of the solenoid valve 7 into the fuel tank 9. Then, a first fuel discharge path 73 merging with the first fuel discharge path 71 at a position closer to the upstream side (nozzle back pressure chamber 37 side) in the direction of flow of fuel than the switching valve chamber 42 of the 2-posiiton 3-way switching valve 6 returns fuel flowing out of the piston control chamber 24 of the pressure intensifier 21 through the switching valve chamber 42 of the 2-posiiton 3-way switching valve 6 into the fuel tank 9.

The downstream end in the direction of flow of fuel of the second fuel discharge path 72 of the present embodiment is connected to the first fuel discharge path 71 at a position closer to the downstream side in the direction of flow of fuel than the switching valve chamber 42 of the 2-position 3-way switching valve 6. Then, the first fuel discharge path 71 closer to the downstream side in the direction of flow of fuel than a merging portion 79 where return fuel flowing through the first fuel discharge path 71 merges with the return fuel flowing through the second fuel discharge path 72 is connected to the return pipe 77 via the leak port of the injector 3. This return pipe 77 is a fuel return pipe line for merging the flow of return fuel (including the flow of leak fuel), which flows out of the piston control chamber 24 of the pressure intensifier 21 of the injector 3 and the nozzle back pressure chamber 37 of the fuel injection nozzle 22, with the flow of return fuel, which flows out of the solenoid valve chamber 51 of the solenoid valve 7, to return the flow of fuel collectively into the fuel tank 9.

Then, the pressure fluctuation propagation preventing means of the present embodiment is constructed of a pressure fluctuation preventing unit 17 for controlling an increase in the pressure of fuel in the solenoid valve chamber 51 of the solenoid valve 7 to a value equal to or lower than the limit of resistance to pressure (for example, the order of 3 MPa) of the O ring 55 of the solenoid valve 7, a fixed restrictor (orifice) 18 for restricting the cross-sectional area of a passage (the amount of flow of fuel), a check valve 19 for preventing fuel from flowing back from the merging portion 79 to the solenoid valve chamber 51 of the solenoid valve 7, and the like. These are interposed between a portion closer to the downstream side in the direction of flow of fuel than the solenoid valve chamber 51 of the solenoid valve 7 and the merging portion 79.

Next, the structure of the pressure fluctuation preventing unit 17 of the present embodiment will be described in brief on the basis of FIG. 4 and FIG. 5. This pressure fluctuation preventing unit 17 is constructed of the nozzle housing (in particular, nozzle holder) 35 of the fuel injection nozzle 22 of the injector 3 or the housing (cylinder) 91 fixed integrally to the housing of the solenoid valve 7, and a piston 92 slidably housed in the sliding bore of this housing 91. A depressed portion (space) communicating with the second fuel discharge path 72 closer to the downstream side in the direction of flow of fuel than the solenoid valve chamber 51 of the solenoid valve 7 is formed on the wall surface of the housing 91. The open end of this depressed portion is provided with an annular stopper 93 for preventing the piston 92 from moving in the right direction in the drawing farther than the initial position. Then, the housing 91 has a communication passage (air passage) 94 connecting the backside end of the depressed portion to the outside is formed in the housing 91.

The piston 92 has a cross section nearly shaped like a letter C so as to partition the depressed portion of the housing 91 into a first volume varying chamber (piston chamber) 95 where internal pressure is kept at an atmospheric pressure and a second volume varying chamber 96 communicating with the second fuel discharge path 72. Then, a spring 97 as piston biasing means for biasing the piston 92 to the side that reduces the internal volume in the second volume varying chamber 96 is placed in the depressed portion of the housing 91. Therefore, the piston 92 slidably fitted in the sliding bore of the housing 91 is pressed onto the stopper 93 at a set load by the spring 97. Then, the first volume varying chamber 95 the periphery of which is surrounded by the housing 91 and the piston 92 allows air to come in and go out through the communication passage 94, whereby pressure in the first volume variable chamber 95 is kept at the atmospheric pressure. Then, an O ring 99 with a backup ring for preventing fuel pressure from leaking from the second volume varying chamber 96 to the first volume varying chamber 95 is fitted in the annular groove 98 formed in the inner wall surface of the housing 91.

Describing the function of the pressure fluctuation preventing unit 17 of the present embodiment, when return fuel of the order of 20 $mm^3$/st flows into the solenoid valve chamber 51 of the solenoid valve 7 via the second fuel discharge path 72 at the time of fuel injection control of the injector 3, the piston 92 is moved in the left direction in the drawing against the biasing force of the spring 97 by the pressure difference applied to the pressure receiving surfaces in the left and right direction in the drawing of the piston 92 to reduce the internal volume of the first volume varying chamber 95. With this, the internal volume of the second volume varying chamber 96 is increased and hence return fuel flows from the solenoid valve chamber 51 of the solenoid valve 7 through the second fuel discharge path 72 into the second volume varying chamber 96 and fuel pressure in the second fuel discharge path 72 is decreased.

With this, an increase in pressure in the solenoid valve chamber is controlled to a value of the order of 3 MPa or less and return fuel of the order of 20 $mm^3$/st flowing into the solenoid valve chamber 51 of the solenoid 7 is discharged to the fuel tank 9 through the second fuel discharge path 72, the merging portion 79, the return pipe 77 before the next fuel injection control timing of the injector 3 of the cylinder. With the above-mentioned construction, even when return fuel of the order of 20 $mm^3$/st flows into the solenoid valve chamber 51 of the solenoid 7 through the second fuel discharge path 72 at the time of fuel injection control of the injector 3, an increase in pressure in the solenoid valve chamber can be controlled to a value of the order of 3 MPa or less. For this reason, it is possible to make sure that the solenoid valve chamber 51 of the solenoid 7 functions as a kind of accumulator provided with the pressure fluctuation preventing unit 17.

Moreover, in the present embodiment, the orifice 18 and the check valve 19 for preventing fuel from flowing into the solenoid valve chamber 51 of the solenoid valve 7 are arranged between the solenoid valve chamber 51 of the solenoid valve 7 and the return pipe 77 and the merging portion 79. This check valve 19 is constructed of a valve body having a valve port, a valve element for opening and closing the valve port, valve element biasing means such as a spring for biasing the valve element to a side to close the valve port, and the like. With this, when high positive pressure develops in the return pipe 77 and the merging portion 79, the check valve 19 is not opened and hence fuel for controlling the amount of injection of fuel of the injector 3 is accumulated in the solenoid valve chamber 51 of the solenoid valve 7 that becomes an accumulator as the whole as described above.

Then, when fuel pressure in the return pipe 77 and the merging portion 79 starts to decrease to fuel vapor pressure, the piston 92 is returned by the biasing force of the spring 97 of the pressure fluctuation preventing unit 17 to discharge fuel to the fuel tank 9 through the second fuel discharge path 72, the merging portion 79, and the return pipe 77. Here, describing the function of the orifice 18, as described above, while fuel is discharged to the fuel tank 9, fuel pressure repeatedly decreases to the fuel vapor negative pressure and increases to a positive pressure of 10 MPa or more and the positive pressure is applied to the orifice 18. Then, when fuel of high pressure is going to flow into the solenoid valve chamber 51 of the solenoid valve 7 in a period of time during which the check valve 10 is closed, the orifice 18 restricts the amount of flow of fuel to make it difficult for the high pressure to propagate to the solenoid valve chamber 51 of the solenoid valve 7.

Features of Second Embodiment

In the pressure intensifying piston type fuel injection apparatus of the present embodiment, the pressure fluctuation preventing unit 17 and the check valve 19 are arranged between the return pipe 77, which merges the flow of return fuel (including leak fuel) flowing out of the piston control chamber 24 of the pressure intensifier 21 of the injector 3 and the nozzle back pressure chamber 37 of the fuel injection nozzle 22 with the flow of fuel flowing out of the solenoid valve chamber 51 of the solenoid valve 7 and returns the flow of fuel collectively to the lower pressure side (fuel tank 9) of the fuel system, and the solenoid valve chamber 51 of the solenoid valve 7. With this construction, the pressure fluctuation of return fuel in the return pipe 77 does not propagate to the solenoid valve chamber 51 of the solenoid valve 7. Therefore, although the pressure intensifying piston type fuel injection apparatus of the present embodiment has an inexpensive structure, the apparatus can protect the sealing part such as the O-ring 55 of the solenoid valve 7 (and portions fastened by screwing) from the pressure fluctuation of return fuel in the return pipe 77. This can eliminate the need for further improving the resistance to pressure of the solenoid valve 7 and hence can reduce the cost of the whole of the system.

Here, FIG. 6 is a graph showing the result of simulation when the injector 3 of the present embodiment is applied to the fuel piping system shown in FIG. 4. From this FIG. 6, it is found that pressure in the return pipe is separated from pressure in the solenoid valve chamber and that the pressure in the solenoid valve chamber is controlled to a value of the order of 3 MPa or the less. Then, in the result of simulation shown in FIG. 6, the horizontal axis shows time and the first vertical axis shows pressure in the solenoid valve chamber and pressure in the return pipe. Then, the second vertical axis shows the piston stroke of the pressure fluctuation preventing unit 17. Then, the rotational speed of the engine is 6000 rpm and the injection interval of the injector 3 is 20 ms. Then, it is found that the piston 92 is returned to an original position within 20 ms by load corresponding to a pressure of 1 MPa and that the pushing pressure when it returns is of the order of 1 MPa.

In this regard, in the present embodiment, air outside the injector 3 is introduced via the communication passage 94 into the first volume varying chamber 95 of the pressure fluctuation preventing unit 17 to keep pressure in the first volume varying chamber 95 at an atmospheric pressure. However, it is also recommendable to keep pressure in the first volume varying chamber 95 at negative pressure lower than the atmospheric pressure by sucking air in the first volume varying chamber 95 of the pressure fluctuation preventing unit 17 by a vacuum pump. In this case, the internal volume of the second volume varying chamber 96 is increased by operating the vacuum pump at the time of fuel injection control of the injector 3 to cause return fuel in the second fuel discharge path 72 to flow into the second volume varying chamber 96. With this, pressure in the solenoid valve chamber can be controlled to a value equal to or smaller than the limit of resistance to pressure (for example, order of 3 MPa or less) of the O-ring 55 of the solenoid valve 7.

Third Embodiment

Figure 7:
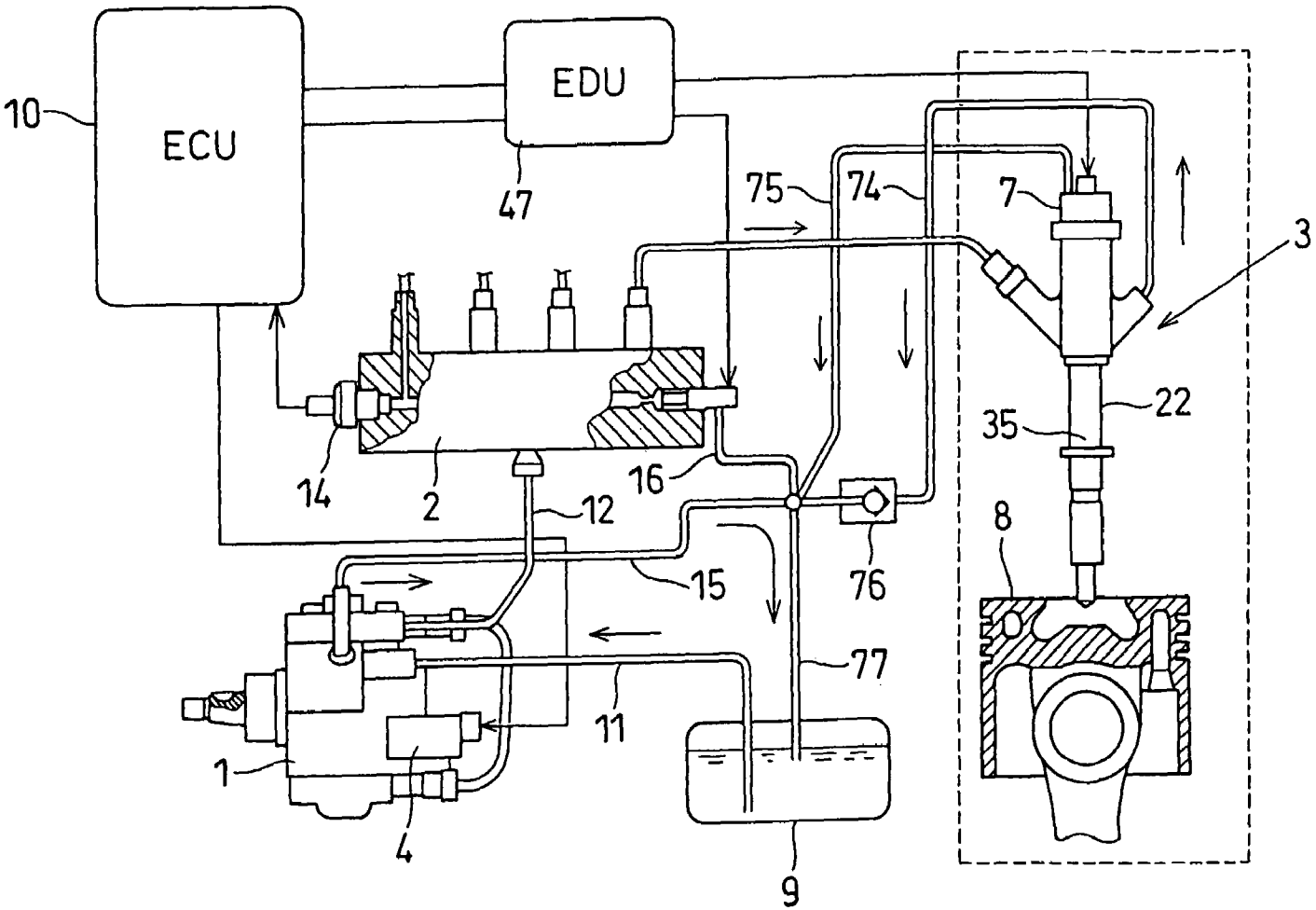
FIG. 7 is a construction diagram showing the fuel piping system of a common rail type fuel injection system (third embodiment).
Figure 8:
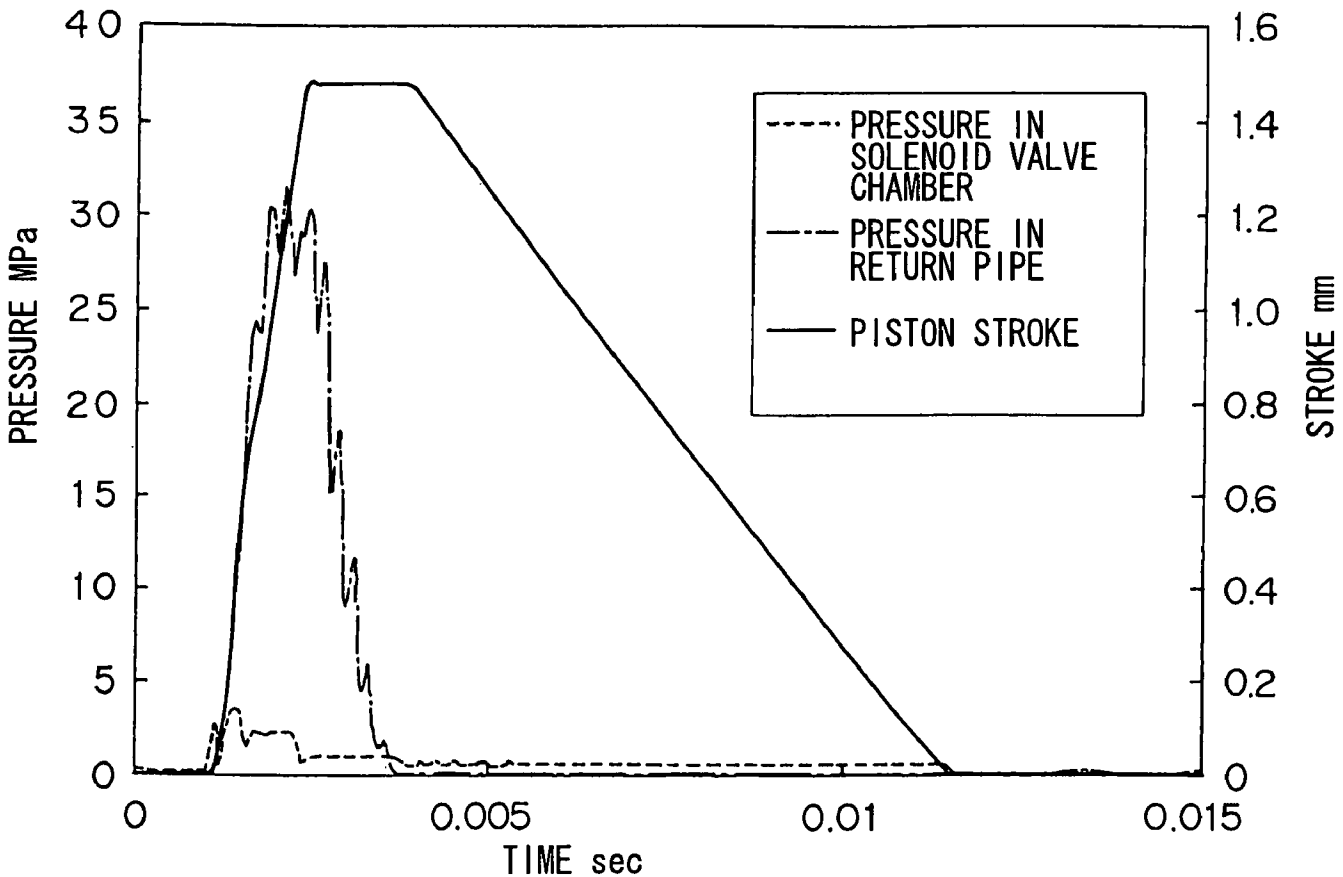
FIG. 8 is a timing chart showing the simulation result when an injector in FIG. 4 is applied to the fuel piping system in FIG. 7 (third embodiment).

FIG. 7 and FIG. 8 shows third embodiment of the present invention. FIG. 7 is a configuration diagram showing the fuel piping system of a common rail type fuel injection system.

The injector 3 of the present embodiment has a first leak port open at the downstream end in the direction of flow of fuel of the first fuel discharge path 71 and the second leak port open at the downstream end in the direction of flow of fuel of the second fuel discharge path 72. A first return pipe 74 for returning surplus fuel flowing out of the respective injectors 3 (in particular, return fuel flowing out of the piston control chamber 24 of the pressure intensifier 21, and return fuel flowing out of the nozzle back pressure chamber 37 of the fuel injection nozzle 22) into the fuel tank 9 is connected between the first leak port of the injector 3 and the fuel tank 9. A check valve 76 for preventing the pressure fluctuation of return fuel in the first return pipe 74 is arranged in this first return pipe 74.

A second return pipe 75 for returning surplus fuel flowing out of the respective injectors 3 (in particular, return fuel lowing out of the solenoid valve chamber 51 of the solenoid valve 7) into the fuel tank 9 is arranged between the second leak port of the injector and the fuel tank 9. The downstream end in the direction of flow of fuel of this second return pipe 75 is connected to the first return pipe (return pipe 77) closer to the downstream side in the direction of flow of fuel than the check valve 76. Therefore, the return pipe 77 is a fuel discharge pipe line that merges surplus fuel flowing out of the supply plump 1 and passing through the return pipe 15 and surplus fuel flowing out of the common rail 2 and passing through the return pipe 16 with surplus fuel flowing out of the respective injectors 3 and returns the fuel collectively to the fuel tank 9.

Here, FIG. 8 is a graph showing the result of simulation when the injector 3 mounted with the pressure fluctuation preventing unit 17 shown in FIG. 4 is applied to the fuel piping system shown in FIG. 7. From this FIG. 8, it is found that pressure in the return pipe is separated from pressure in the solenoid valve chamber and that the pressure in the solenoid valve chamber is controlled to a value of the order of 3 MPa or the less. Then, in the result of simulation in FIG. 8, as is the case with second embodiment, the horizontal axis shows time and the first vertical axis shows pressure in the solenoid valve chamber and pressure in the return pipe. Then, as is the case with second embodiment, the second vertical axis shows the piston stroke of the pressure fluctuation preventing unit 17. Then, the rotational speed of the engine is 6000 rpm and the injection interval of the injector 3 is 20 ms. Then, it is found that the piston 92 is returned to an original position within 20 ms by load corresponding to a pressure of 1 MPa and that the pushing pressure when it returns is of the order of 1 MPa.

Fourth Embodiment

Figure 9:
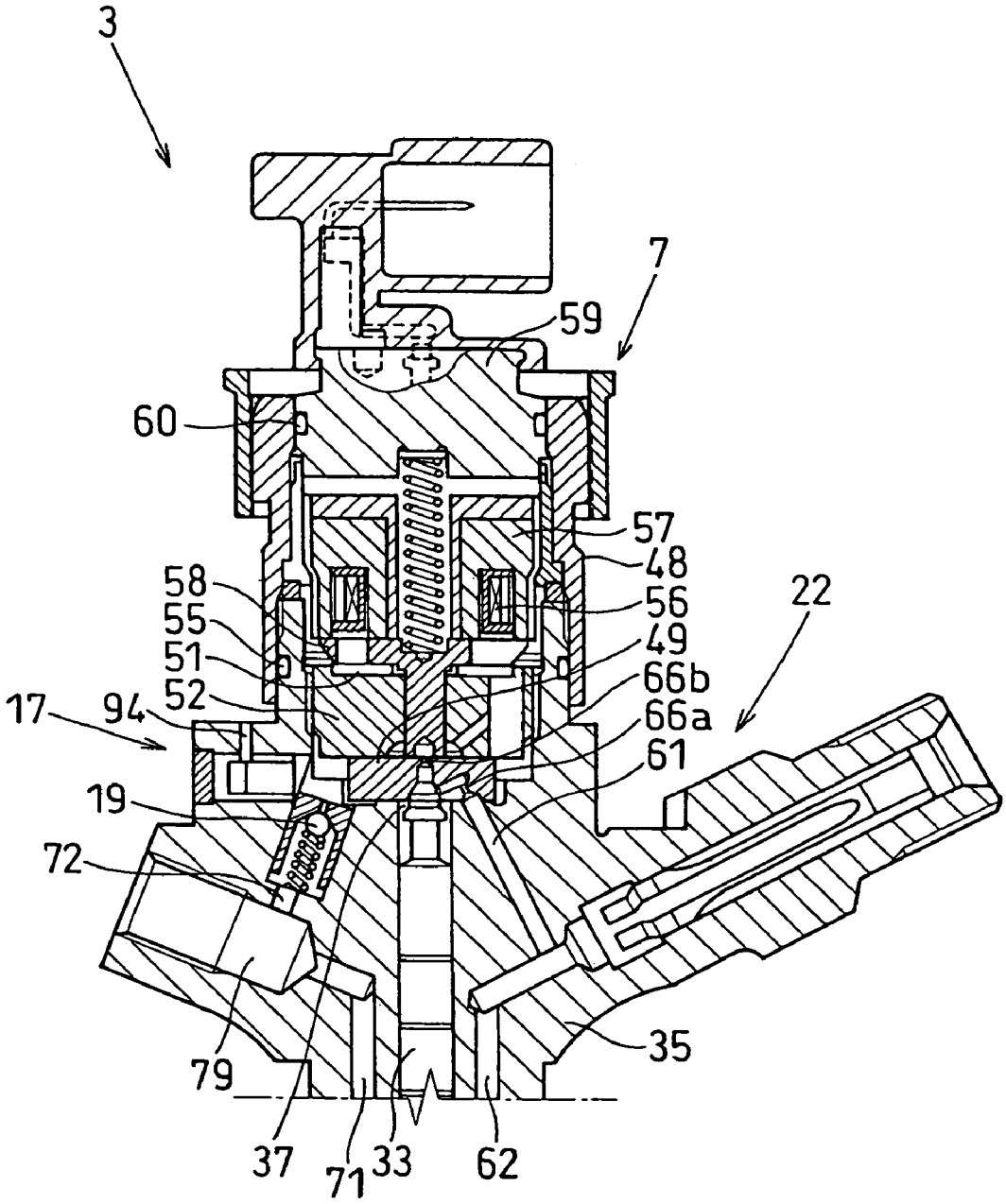
FIG. 9 is a cross-sectional view showing the partial structure of an injector (fourth embodiment).

FIG. 9 shows fourth embodiment of the present invention. FIG. 9 is a cross-sectional view showing the partial structure of an injector used for a pressure intensifying type fuel injection apparatus.

The injector 3 of the present embodiment is integrally provided with a pressure intensifier (not shown), the fuel injection nozzle 22, the 2-position 3-way switching valve (not shown), the solenoid valve 7, the pressure fluctuation preventing unit 17, the check valve 19, and the like to construct a pressure intensifying type injector. With this, the common rail type fuel injection system of the present embodiment constructs a pressure intensifying piston type fuel injection apparatus.

The solenoid valve 7 with the 2-position 3-way switching valve is fastened to the nozzle housing 35 of the fuel injection nozzle 22 by the use of a retaining nut 48. This retaining nut 48 has an inner peripheral threaded portion screwed onto the outer peripheral threaded portion of the nozzle housing 35. Then, the retaining nut 48 is a part for putting the contact surface (bottom end surface in the drawing) of the valve body 52 of the solenoid valve 7 into close contact with the contact surface (top end surface in the drawing) of the nozzle housing 35 via an orifice plate 49 having an inlet side orifice 66*a* and an outlet side orifice 66*b* by a specified axial fastening force by screwing.

Then, the injector 3 of the present embodiment forms the solenoid valve chamber 51 between the valve body 52 of the solenoid valve 7 and the nozzle housing 35 of the fuel injection nozzle 22. Then, the O ring (sealing part) 55 for preventing fuel from leaking from the solenoid valve chamber 51 to the outside of the injector 3 is interposed between the outer periphery of the nozzle housing 35 and the inner periphery of the retaining nut 48. Then, the electromagnetic driving part of the solenoid valve 7 is constructed of a solenoid coil 56, a stator core 57, an armature 58, a housing 59, and the like. Here, an O ring (sealing part) 60 for preventing fuel from leaking from the solenoid valve chamber 51 to the outside of the injector 3 is interposed between the outer periphery of the housing 59 and the inner periphery of the retaining nut 48.

Then, in the injector 3 of the present embodiment are formed the first fuel introduction path (first fuel introduction passage) 61 for introducing fuel from the common rail 2 into the nozzle back pressure chamber 37 of the fuel injection nozzle 22 via the switching valve chamber of the 2-position 3-way switching valve (not shown) and the second fuel introduction path (second fuel introduction passage) 62 for introducing fuel of high pressure from the common rail 2 into the fuel reserving chamber (not shown) of the fuel injection nozzle 22 via the pressure intensifying chamber (not shown) of the pressure intensifier. Then, as is the case with second embodiment, the first fuel introduction paths (first fuel introduction passages) 63, 64 and the second fuel introduction path (second fuel introduction passage) 65 are formed in the injector 3.

Moreover, in the injector 3 of the present embodiment are formed the first fuel discharge path (first fuel discharge passage) 71 for discharging fuel flowing out of the nozzle back pressure chamber 37 of the fuel injection nozzle 22 into the return pipe 77 through the switching valve chamber of the 2-position 3-way switching valve (refer to FIG. 4) and the second fuel discharge path (second fuel discharge passage) 72 for discharging fuel flowing out of the pressure control chamber (not shown) of the 2-position 3-way switching valve into the return pipe 77 through the solenoid valve chamber 51 of the solenoid valve 7. Then, as is the case with second embodiment, the first fuel discharge path (first fuel discharge passage) 73 is formed in the injector 3. Then, the pressure fluctuation preventing unit 17 and the check valve 19 are interposed between a portion closer to the downstream side in the direction of flow of fuel than the solenoid valve chamber 51 of the solenoid valve 7 and the merging portion 79 where return fuel flowing through the first fuel discharge path 71 merges with return fuel flowing through the second fuel discharge path 72. Here, the first fuel discharge path 71 closer to the downstream side in the direction of flow of fuel than the merging portion 79 is connected to the return pipe 77 via the leak port of the injector 3.

[Modifications]

In the present embodiments, an example has been described in which an electromagnetic type hydraulic control valve constructed of the hydraulically operated type 2-position 3-way switching valve 6 and the solenoid valve 7 is used as an actuator for controlling the amount of lift of the nozzle needle 32 of the fuel injection nozzle 22 mounted in correspondence with each cylinder of the internal combustion engine such as a diesel engine and for controlling the amount of lift of the pressure intensifying piston 26 of the pressure intensifier 21 mounted in correspondence with each fuel injection nozzle 22. However, it is also recommendable to arrange a hydraulically operated type 2-position opening/closing valve in the first fuel introduction path 61 (or first fuel introduction passage 63) and to arrange a hydraulically operated 2-position opening/closing valve in the first fuel discharge path 71 (or first fuel discharge passage 73) and to perform the control of increasing/decreasing fuel pressures in the respective pressure control chambers of these two 2-position opening/closing valves by one solenoid valve or multiple solenoid valves.

In the present embodiment, an example has been described in which the fuel injection apparatus for an internal combustion engine of the present invention is applied to a pressure intensifying piston type fuel injection apparatus mounted in a common rail type fuel injection system and provided with the pressure-intensifying piston 26. However, it is also recommendable to apply the fuel injection apparatus for an internal combustion engine of the present invention to a pressure intensifying piston type fuel injection apparatus of the type in which there is not provided an accumulator or an accumulating pipe such as the common rail 2 but low-pressure fuel is pressure-supplied from a fuel injection pump directly to the pressure intensifier 21 or the fuel injection nozzle 22 via a fuel supply pipe. Moreover, it is also recommendable to use an in-line fuel injection pump or a distribution type fuel injection pump as a fuel injection pump (fuel supply means) for discharging low-pressure fuel.

In the present embodiment, the first fuel discharge path (first return passage) 71 for merging return fuel flowing out of the piston control chamber 24 of the pressure intensifier 21 with return fuel flowing out of the nozzle back pressure chamber 37 of the fuel injection nozzle 22 to return the return fuel collectively to the fuel tank 9 of the lower pressure side of the fuel system is formed in the injector 3. However, it is also recommended that a first fuel discharge path (return passage, pipe line, oil passage) for returning the flow of return fuel flowing out of the piston control chamber 24 of the pressure intensifier 21 and return fuel flowing out of the nozzle back pressure chamber 37 of the fuel injection nozzle 22 separately from and independently of each other in terms of pipe line to the fuel tank 9 of the lower pressure side of the fuel system is formed in the injector 3.

In the present embodiment, the first fuel introduction path 61 for introducing fuel from the first communication chamber of the switching valve chamber 42 of the 2-position 3-way switching valve 6 into the piston control chamber 24 of the pressure intensifier 21 and the nozzle back pressure chamber 37 of the fuel injection nozzle 22 and the first fuel discharge path 71 for flowing return fuel flowing out of the piston control chamber 24 of the pressure intensifier 21 and the nozzle back pressure chamber 37 of the fuel injection nozzle 22 into the second communication chamber of the switching valve chamber 42 of the 2-position 3-way switching valve 6 are constructed of one passage (pipe line, oil passage). However, it is also recommendable to construct the first fuel introduction path 61 and the first fuel discharge path 71 of two passages (pipe lines, oil passages) that are separated from and independent of each other in terms of pipeline.

What is claimed is:

1. A fuel injection apparatus for an internal combustion engine, said apparatus comprising:

a pressure intensifier for intensifying pressure of fuel supplied from a fuel injection pump;

a fuel injection nozzle for injecting fuel having pressure intensified by the pressure intensifier into a cylinder of the internal combustion engine;

a solenoid valve for performing control of intensifying pressure of the pressure intensifier or control of opening or closing the fuel injection nozzle;

a first fuel discharge path through which fuel flowing out of the pressure intensifier or the fuel injection nozzle bypasses the solenoid valve to return the fuel into a low pressure side of a fuel system;

a second fuel discharge path through which fuel flowing out of the solenoid valve bypasses the first fuel discharge path to return the fuel to a low pressure side of the fuel system;

a hydraulically operated type 2-position switching valve having a first position that can introduce fuel discharged from the the fuel injection pump into the pressure intensifier or the fuel injection nozzle and a second position that can return fuel flowing out of the pressure intensifier or the fuel injection nozzle to a lower pressure side of the fuel system, wherein the solenoid valve has a solenoid valve chamber provided therein and has a sealing part for preventing fuel from leaking from this solenoid valve chamber to the outside and performs control of increasing or descrasing hydraulic pressure of fuel applied to the 2-position switching valve to switch a position of the 2-position switching valve.

2. The fuel injection apparatus for an internal combustion engine according to claim 1, further comprising:

an injector integrally provided with the pressure intensifier, the fuel injection nozzle, the solenoid valve and the 2-position switching valve and having the first fuel discharge path and the second fuel discharge path formed therein;

a first return pipe interposed between the injector and the low pressure side of the fuel system and connected to a downstream end in the direction of flow of fuel of the first fuel discharge path; and a second return pipe interposed between the injector and the low pressure side of the fuel system and connected to a downstream end in the direction of flow of fuel of the second fuel discharge path, wherein the second return pipe is separately and independently provided from the first return pipe.

3. The fuel injection apparatus for an internal combustion engine according to claim l, further comprising:

an injector integrally provided with the pressure intensifier, the fuel injection nozzle, the solenoid valve, and the 2-position switching valve and having the first fuel discharge path and the second fuel discharge path formed therein;

a first return pipe interposed between the injector and the low pressure side of the fuel system and connected to a downstream end in the direction of flow of fuel of the first fuel discharge path;

a second return pipe interposed between the injector and the low pressure side of the fuel system and connected to a downstream end in the direction of flow of fuel of the second fuel discharge path; and a check valve for controlling pressure fluctuation in the first return pipe, arranged in the middle of the first return pipe and, wherein a downstream end in the direction of flow of fuel of the second return pipe is connected to the first return pipe closer to a downstream side in the direction of flow of fuel than the check valve.

4. A fuel injection apparatus for an internal combustion engine comprising:

a pressure intensifier for intensifying pressure of fuel supplied from a fuel injection pump;

a fuel injection nozzle for injecting fuel having pressure intensified by the pressure intensifier into a cylinder of the internal combustion engine;

a solenoid valve for performing control of intensifying pressure of the pressure intensifier or control of opening or closing the fuel injection nozzle;

a return pipe for merging flow of fuel flowing out of the pressure intensifier or the fuel injection nozzle with flow of fuel flowing out of the solenoid valve to return fuel collectively to a lower pressure side of a fuel system; and a pressure fluctuation propagation preventing means for preventing pressure fluctuation in the return pipe from propagating to the solenoid valve, interposed between the solenoid valve and the return pipe.

5. The fuel injection apparatus for an internal combustion engine according to claim 4, further comprising:

a hydraulically operated type 2-position switching valve having a first position that can introduce fuel discharged from the fuel injection pump into the pressure intensifier or the fuel injection nozzle and a second position that can return fuel flowing out of the pressure intensifier or the fuel injection nozzle to a lower pressure side of the fuel system, wherein the solenoid valve has a solenoid valve chamber provided therein and has a sealing part for preventing fuel from leaking from this solenoid valve chamber to the outside and performs control of increasing or decreasing hydraulic pressure of fuel applied to the 2-position switching valve to switch a position of the 2-position switching valve.

6. The fuel injection apparatus for an internal combustion engine according to claim 5, further comprising:

an injector integrally provided with the pressure intensifier, the fuel injection nozzle, the solenoid valve, and the 2-position switching valve, wherein the injector includes a first fuel discharge path and a second fuel discharge path, the first fuel discharge path being for returning fuel flowing out of the pressure intensifier or the fuel injection nozzle to a lower pressure side of the fuel system via the return pipe and the second fuel discharge path being for returning fuel flowing out of the solenoid valve chamber to a low pressure side of the fuel system via the return pipe.

7. The fuel injection apparatus for an internal combustion engine according to claim 6, further comprising:

a first return pipe interposed between the injector and the return pipe and connected to a downstream end in the direction of flow or fuel of the first fuel discharge path; and a second return pipe interposed between the injector and the return pipe and connected to a downstream end in the direction of flow of fuel of the second fuel discharge path; and a check valve for controlling pressure fluctuation in the first return pipe, arranged in the middle of the first return pipe, wherein a downstream end in the direction of flow of fuel of the second return pipe is connected to the first return pipe or the return pipe closer to a downstream side in the direction of flow of fuel than the check valve.

8. The fuel injection apparatus for an internal combustion engine according to claim 7, wherein the pressure fluctuation propagation preventing means includes a pressure fluctuation preventing unit for controlling an increase in pressure in the solenoid valve chamber to a value lower than a limit of resistance to pressure of a sealing part of the solenoid valve, and the pressure fluctuation preventing unit including a first volume varying chamber into which pressure lower than pressure in the second fuel discharge path is introduced, a second volume varying chamber communicating with the second fuel discharge path, a piston interposed between the first volume varying chamber and the second volume varying chamber, and piston biasing means for biasing the piston to a side to reduce volume of the second volume varying chamber.

9. The fuel injection apparatus for an internal combustion engine according to claim 6, wherein the pressure fluctuation propagation preventing means is provided with a check valve for preventing fuel from flowing from the return pipe and the first fuel discharge path to the second fuel discharge path.

10. A fuel injection method for an internal combustion engine, said method comprising:

intensifying pressure of fuel supplied from a fuel injection pump;

injecting at least some of said intensified pressure fuel through a nozzle into a cylinder of the internal combustion engine;

controlling said intensified fuel pressurization or opening or closing of the fuel injection nozzle using a solenoid valve;

merging a flow of intensified pressure fuel or fuel flowing from the injection nozzle with fuel flowing out of the solenoid valve via a return pipe to return fuel collectively to a lower pressure side of a fuel system; and preventing pressure fluctuation in the return pipe from propagating to the solenoid valve at a location interposed between the solenoid valve and the return pipe.

* * * * *